US006060874A

United States Patent [19]

Doorenbos

[11] Patent Number: 6,060,874

[45] Date of Patent: May 9, 2000

[54] METHOD OF CURVATURE COMPENSATION, OFFSET COMPENSATION, AND CAPACITANCE TRIMMING OF A SWITCHED CAPACITOR BAND GAP REFERENCE

[75] Inventor: Jerry L. Doorenbos, Tucson, Ariz.

[73] Assignee: Burr-Brown Corporation, Tucson, Ariz.

[21] Appl. No.: 09/359,251

[22] Filed: Jul. 22, 1999

[51] Int. Cl.[7] ..... G05F 3/16

[52] U.S. Cl. ..... 323/316; 323/907

[58] Field of Search ..... 323/316, 907, 323/315, 313, 288

[56] References Cited

U.S. PATENT DOCUMENTS

| | | | |
|---|---|---|---|
| 4,355,285 | 10/1982 | Kelley et al. | 330/9 |
| 4,375,595 | 3/1983 | Ulmer et al. | 307/297 |
| 4,714,843 | 12/1987 | Smith | 307/491 |
| 4,939,442 | 7/1990 | Carvajal et al. | 323/281 |
| 5,059,820 | 10/1991 | Westwick | 307/296.6 |
| 5,352,972 | 10/1994 | Pernici et al. | 323/313 |
| 5,408,174 | 4/1995 | Leonowich | 323/315 |
| 5,519,308 | 5/1996 | Gilbert | 323/313 |
| 5,563,504 | 10/1996 | Gilbert et al. | 323/316 |

FOREIGN PATENT DOCUMENTS

| | | |
|---|---|---|
| 58-109912 | 6/1983 | Japan . |
| 58-114109 | 7/1983 | Japan . |

*Primary Examiner*—Shawn Riley
*Attorney, Agent, or Firm*—Cahill, Sutton & Thomas P.L.C.

[57] ABSTRACT

Curvature in a reference voltage produced by a switched capacitor band gap reference circuit is compensated by producing a first $\Delta V_{BE}$ voltage by causing first and second PTAT/R currents to flow through a first $\Delta V_{BE}$-generating circuit. The first $\Delta V_{BE}$ voltage is applied to a first terminal of a first capacitor having a second terminal coupled to a summing conductor of an operational amplifier producing the reference voltage. A second $\Delta V_{BE}$ voltage is produced by causing a third PTAT/R current and a fourth current to flow through a second $\Delta V_{BE}$-generating circuit. The second $\Delta V_{BE}$ voltage is applied to a first terminal or a second capacitor having a second terminal coupled to the summing conductor. First and second charges are transferred from the first and second capacitors through the summing conductor into a feedback capacitor coupled between the summing conductor and an output of the operational amplifier to produce the compensated reference voltage on the output of the operational amplifier. A technique of storing a voltage on the feedback capacitor equal to a $V_{BE}$ voltage minus a voltage on the summing conductor during a charging phase, and then connecting the feedback capacitor between the summing conductor and the output of the operational amplifier cancels the offset voltage of the amplifier.

47 Claims, 10 Drawing Sheets

SAMPLE/ HOLD & BUFFER CIRCUITRY
$V_{REF}$
$V_{OUT}$
$+V_S$
$I_{PTAT/R}$
$I_{OTC/R}$
NI
I
$V_{BE31}$ OR $V_{BE32}$
$V_{BE11}$ OR $V_{BE12}$
$C_{2A}$
$C_1$
$C_2$
$C_4$
$Q_1$
$Q_3$
$\phi_1$
$\phi_2$
1
2
3
4
10
11
12
13
14
16
17
18
19
20
21
22
23
24
25
26
27
28

SETTLING PHASE Ø2

1A $V_{REG}$
$I_{VBE/R}$
$\overline{\phi}_{3B}$
$I_{PT0}$
$I_{PT2}$
$I_{PT1}$
$I_{PT7}$
$I_{PT3}$
$\phi_{3A2}$
$\overline{\phi}_{3A2}$
$\phi_{3A}$
$\overline{\phi}_{3A}$
$\phi_{2A}$
$\phi_2$
$\phi_{1A}$
$\phi_{3B}$
$V_{OUT}$
$V_{REF}$
$V_{REF'}$
HOLD
$\overline{HOLD}$
$C_2$
$C_2'$
$C_{2A}$
$C_{2A}'$
$C_4$
$C_1$
$C_1'$
$C_1''$
$Q_1$
$Q_2$
$Q_3$
$Q_4$
$Q_5$
1A
2A
3
4A
4B
4C
4D
12
14
20
24
25
26
26A
26B
27
28
28A
29
30
33
34
35
36
37
38
39
40
41
42
43
44
45
49
50
52
54
55
61A
61B
66

FIG. 6
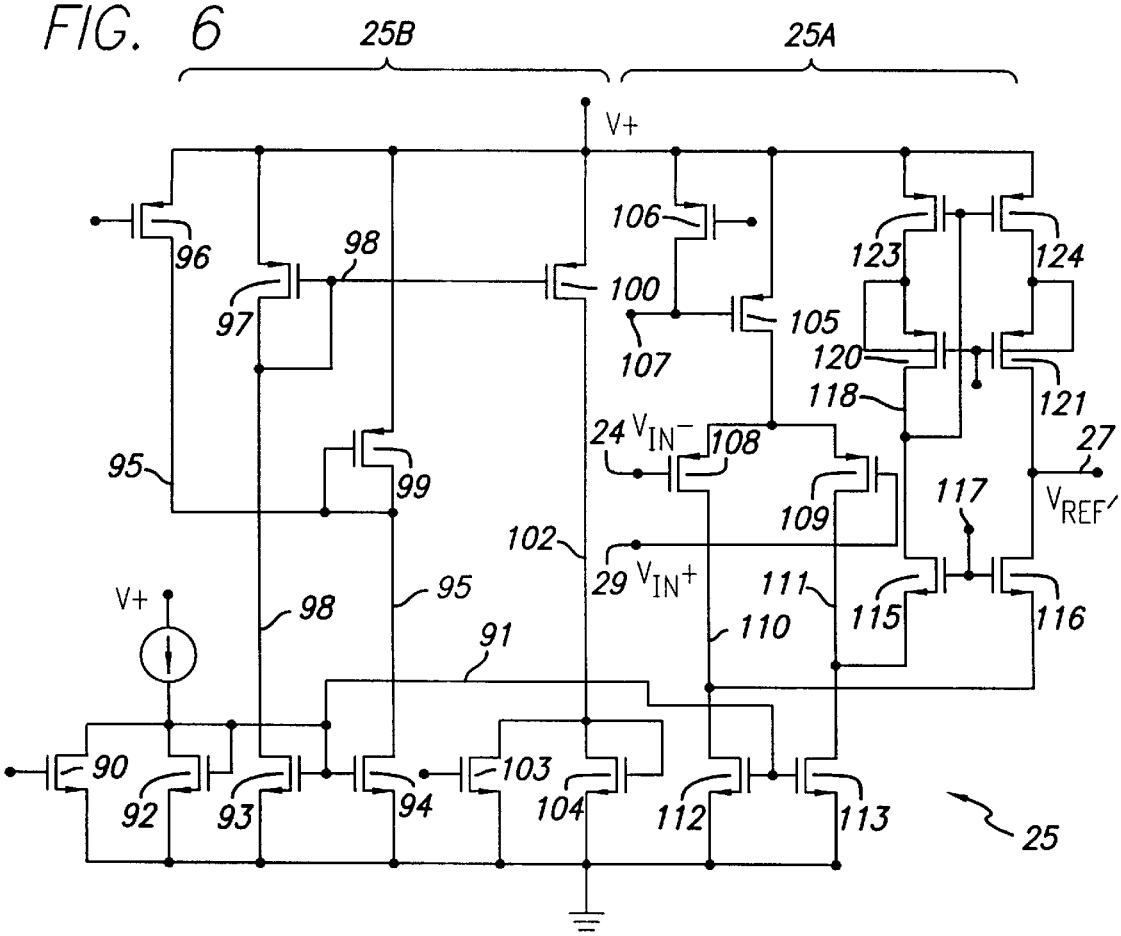
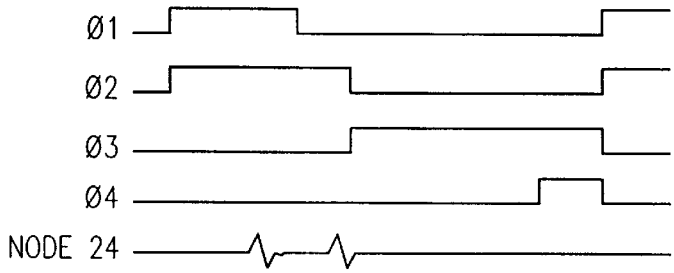
FIG. 7
FIG. 8
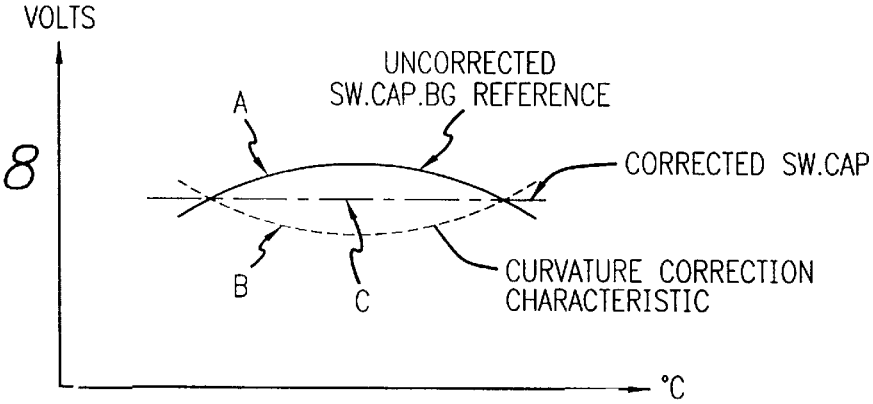

B7
B6
B5
B4
B3
B2
B1
B0
125-7
125-1
125-0
131-7
131-2
131-1
131-0
57
C2
24
C2A
127-7
60FF
30FF
15FF
7.5FF
10FF
8FF
7FF
6.5FF
127-2
127-1
127-0
6FF
±4FF
±2FF
±1FF
±0.5FF
132-3
132-1
132-0
134-3
134-1
135-3
135-1
135-0
134-0
133-0
133-1
133-3
B3
B2
B1
B0
56
129-7
129-2
129-1
129-0
62

METHOD OF CURVATURE COMPENSATION, OFFSET COMPENSATION, AND CAPACITANCE TRIMMING OF A SWITCHED CAPACITOR BAND GAP REFERENCE

BACKGROUND OF THE INVENTION

The invention relates to switched capacitor band gap reference circuits, and more particularly to "curvature correction" therefor.

The closest prior art is believed to include U.S. Pat. Nos. 5,059,820, 4,375,595 (Ulmer et al.), and U.S. Pat. No. 5,563,504 (Gilbert et al.), which disclose switched capacitor band gap reference circuits having no curvature compensation.

Silicon band-gap voltage reference circuits are widely used to provide precision internal reference voltages in integrated circuits. There are many implementations of band-gap reference circuits, most of which have been of a "continuous time" nature. That is, most of the known band-gap reference circuits are analog circuits that do not include switching circuitry. However, many CMOS integrated circuit structures include nearly ideal capacitors; this has led to development of accurate band-gap reference voltage circuits using "discrete time" switched capacitor circuits. The above mentioned patents disclose several such switched capacitor band-gap voltage reference circuits, in which ratios of nearly ideal capacitors determine reference voltage scaling factors.

Prior art FIG. 1 shows switched capacitor voltage reference circuit 1, which includes a conventional switched capacitor voltage reference circuit 2 as generally disclosed in above mentioned U.S. Pat. No. 5,059,820, with a conventional sample/hold and buffer output circuit 4. Briefly, the currents NI and I of current sources 16 and 18, respectively, are time-multiplexed during non-overlapping clock signals $\phi 1$ and $\phi 2$ to produce the current $I_1$ flowing through diode-connected transistor Q1 so as to produce in a capacitor C2A a charge proportional to a $V_{BE}$ voltage of transistor Q1 when it is conducting current NI; that charge, which has a negative temperature coefficient, then is transferred to feedback capacitor C2. Then, a change in charge proportional to a $\Delta V_{BE}$ voltage which transistor Q1 undergoes when the current through it changes from NI to I is stored on capacitor C1; that charge, which is proportional to absolute temperature, then is transferred to feedback capacitor C2. The net charge transferred to feedback capacitor C2 is converted by operational amplifier 25 to the voltage $V_{OUT}$ on conductor 27. A conventional sample and hold circuit and buffer circuit 4 simply converts the voltage $V_{OUT}$ to a "continuous time" reference voltage $V_{REF}$.

The circuit of prior art FIG. 1 and all of the known band-gap reference circuits perform, in essence, the summation of a base-emitter voltage $V_{BE}$ of a transistor which has a negative temperature coefficient with a PTAT (proportional to absolute temperature) voltage which has a positive temperature coefficient in order to achieve cancellation of the positive and negative temperature coefficients. However, all band-gap reference circuits also exhibit an inherent undesirable "curvature" in their reference voltage versus temperature characteristic, due to the non-linearity of the temperature coefficient of the $V_{BE}$ voltage of any bipolar transistor. So-called "curvature compensation" circuitry has been used in conjunction with the known "continuous time" band-gap voltage reference circuits in order to achieve reduction in such curvature, as shown in U.S. Pat. No. 5,519,308 (Gilbert et al.). However, the known prior curvature compensation circuits are compatible only with the known "continuous time" or analog band-gap voltage reference circuits, but have not been used with switched capacitor band-gap voltage reference circuits.

SUMMARY OF THE INVENTION

Accordingly, it is an object of the invention to provide a curvature correction circuit for a switched capacitor band gap reference voltage circuit.

It is another object of the invention to avoid the effects of thermal drift in a switched capacitor band gap reference voltage circuit.

It is another object of the invention to provide a band gap reference circuit which is more accurate than has been achievable using either prior continuous time band gap reference circuits or prior switched capacitor band gap reference circuits.

It is another object of the invention to provide a switched capacitor band gap reference circuit in which the switched capacitor circuits conveniently eliminate the effect of input offset of an amplifier therein.

It is another object of the invention to provide a circuit and method for trimming integrated circuit capacitances with a degree of accuracy that is substantially higher than the accuracy of the capacitance of a minimum sized capacitor that can be manufactured using a particular manufacturing process.

Briefly described, and in accordance with one embodiment thereof, the invention provides a curvature compensated switched capacitor band gap reference circuit, a switched capacitor band gap reference circuit including a first $\Delta V_{BE}$-generating circuit. The first $\Delta V_{BE}$-generating circuit includes at least a first transistor (Q1), a first current switching circuit (44,45,52) adapted to produce first (IPT1) and second (IPT7+IPT1) currents through the first $\Delta V_{BE}$-generating circuit causing it to produce a first $\Delta V_{BE}$ voltage and transfer a corresponding first charge into a summing conductor (24) and a feedback capacitor C2) of an operational amplifier (25). The first $\Delta V_{BE}$-generating circuit also includes a second capacitor (C2A) coupled to store a $V_{BE}$ voltage and transfer a corresponding second charge into the summing conductor (24) and the feedback capacitor (C2). A curvature correction circuit includes a second $\Delta V_{BE}$-generating circuit. The second $\Delta V_{BE}$-generating circuit includes at least a second transistor (Q3) and a second current switching circuit (41,42,14) adapted to produce only a third current (IPTO) and then only a fourth current ($I_{OTC}$) through the second $\Delta V_{BE}$-generating circuit causing it to produce a second $\Delta V_{BE}$ voltage, and a curvature correction capacitor (C4) coupled to receive the second $\Delta V_{BE}$ voltage and couple a corresponding curvature correction charge into the summing conductor (24) and the feedback capacitor (C2), to thereby produce a curvature compensated voltage on an output of the operational amplifier, the first, second and third currents being PTAT/R currents. In one embodiment a first current source (43) is connected to produce a PTAT/R current (IPT2) through a third transistor (Q2), causing it to produce the $V_{BE}$ voltage. In one embodiment the fourth current is a $V_{BE}$/R current, and the second current switching circuit is adapted to cause the third current and then both the third current and the fourth current to flow through the second transistor (Q3). In the described embodiments the various PTAT/R currents are produced by applying a PTAT voltage across a resistor having a non-zero temperature coefficient. The capacitances of the third capacitor (C2A) and the feedback capacitor (C2) can be trimmed to maintain a constant sum of the capacitances of the feedback capacitor (C2) and the third capacitor (C2A) by providing a capacitance trimming array (62) including a group of trim capacitors (127) each having a first conductor coupled to the summing conductor (24), a first terminal (57), a second terminal coupled to the summing conductor (24), and a third terminal (56), the feedback capacitor (C2) being coupled between the first (57) and second (24) terminals, and the third capacitor (C2A) being coupled between the second terminal (24) and the third terminal (56). A trim capacitor (C127-i) of the group (127) can be switched into parallel connection with the feedback capacitor (C2) and while also switching that trim capacitor (C127-i) out of parallel connection with the third capacitor (C2A) in response to a first logic level (B-i) of a corresponding bit of a digital trim word, or vice versa. Very small trim adjustments to the capacitances of the feedback capacitor (C2) can be made by providing a capacitance trimming array (62) including a first group of trim capacitors (127), a second group of trim capacitors (132), a first terminal (57), and a second terminal (24), the feedback capacitor (C2) being coupled between the first (57) and second (24) terminals. A trim capacitor (C127-i) of the first group (127) can be switched into parallel connection with the feedback capacitor (C2) and simultaneously switching a corresponding trim capacitor (132-i) of the second group (132) out of parallel connection with the feedback capacitor (C2) in response to a first logic level (B-i) of a corresponding bit of a digital trim word, or vice versa, to cause a change in the capacitance between the first and second terminals by an amount equal to the difference between the capacitances of the corresponding capacitors of the first and second groups.

BRIEF DESCRIPTION OF THE DRAWINGS

FIG. 6 is a detailed circuit schematic diagram of the amplifier 25 in FIG. 4.

FIG. 7 is a timing diagram for the timing signals $\phi 1$, $\phi 2$, $\phi 3$ and $\phi 4$ and the voltage on summing node 24 of FIG. 3A.

FIG. 8 is a graph illustrating "curvature" of an uncorrected switched capacitor band gap reference circuit output voltage, a correction signal produced by the curvature correction circuit 3 of FIG. 4, and the corrected band gap reference voltage produced by the curvature-corrected switched capacitor band gap reference circuit of FIG. 4.

DETAILED DESCRIPTION OF THE PREFERRED EMBODIMENTS

Figure 1:
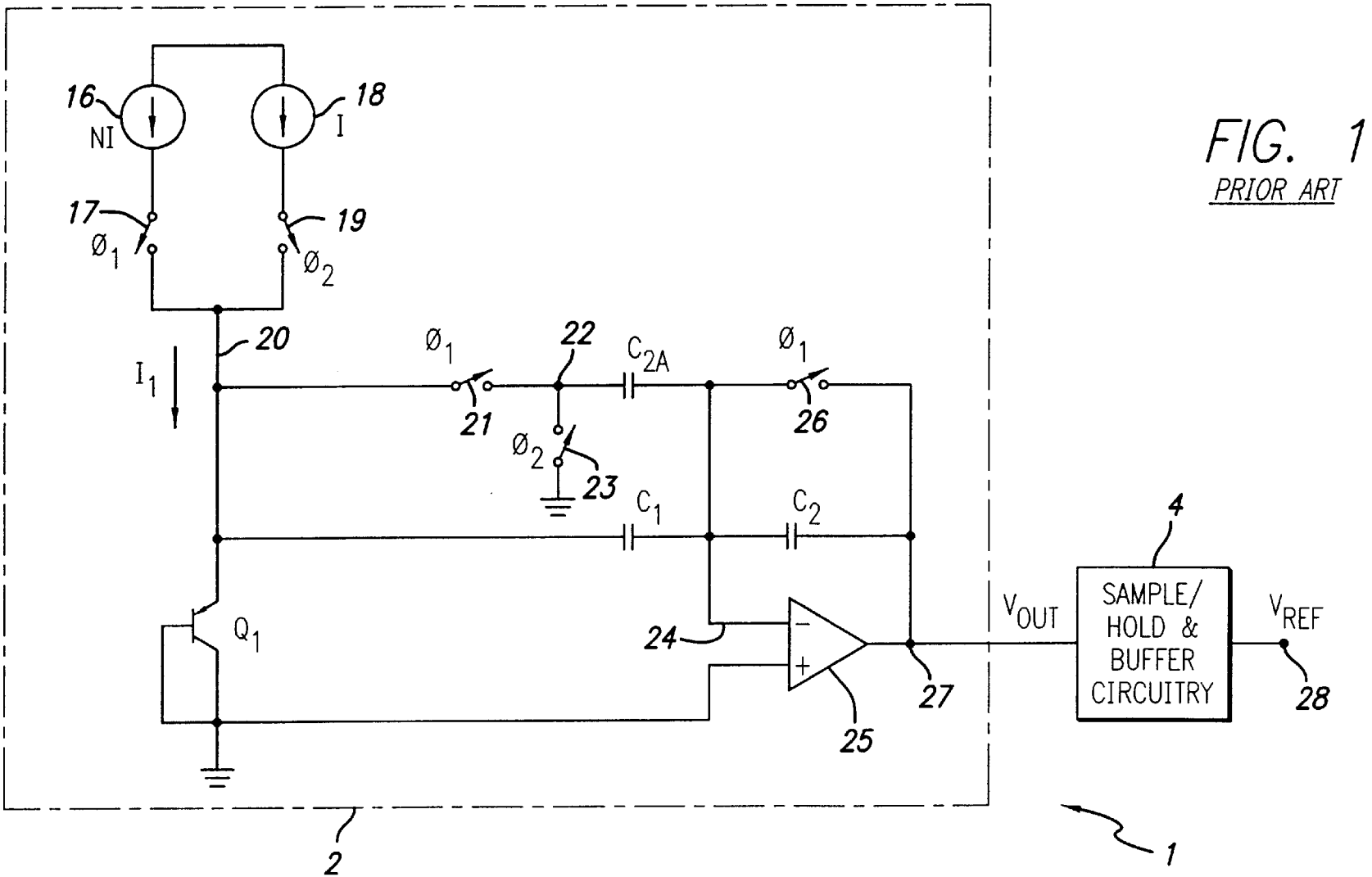
FIG. 1 PRIOR ART
FIG. 1 is a schematic diagram of a prior art switched capacitor band gap reference circuit generally as disclosed in U.S. Pat. No. 5,059,820.
Figure 2:
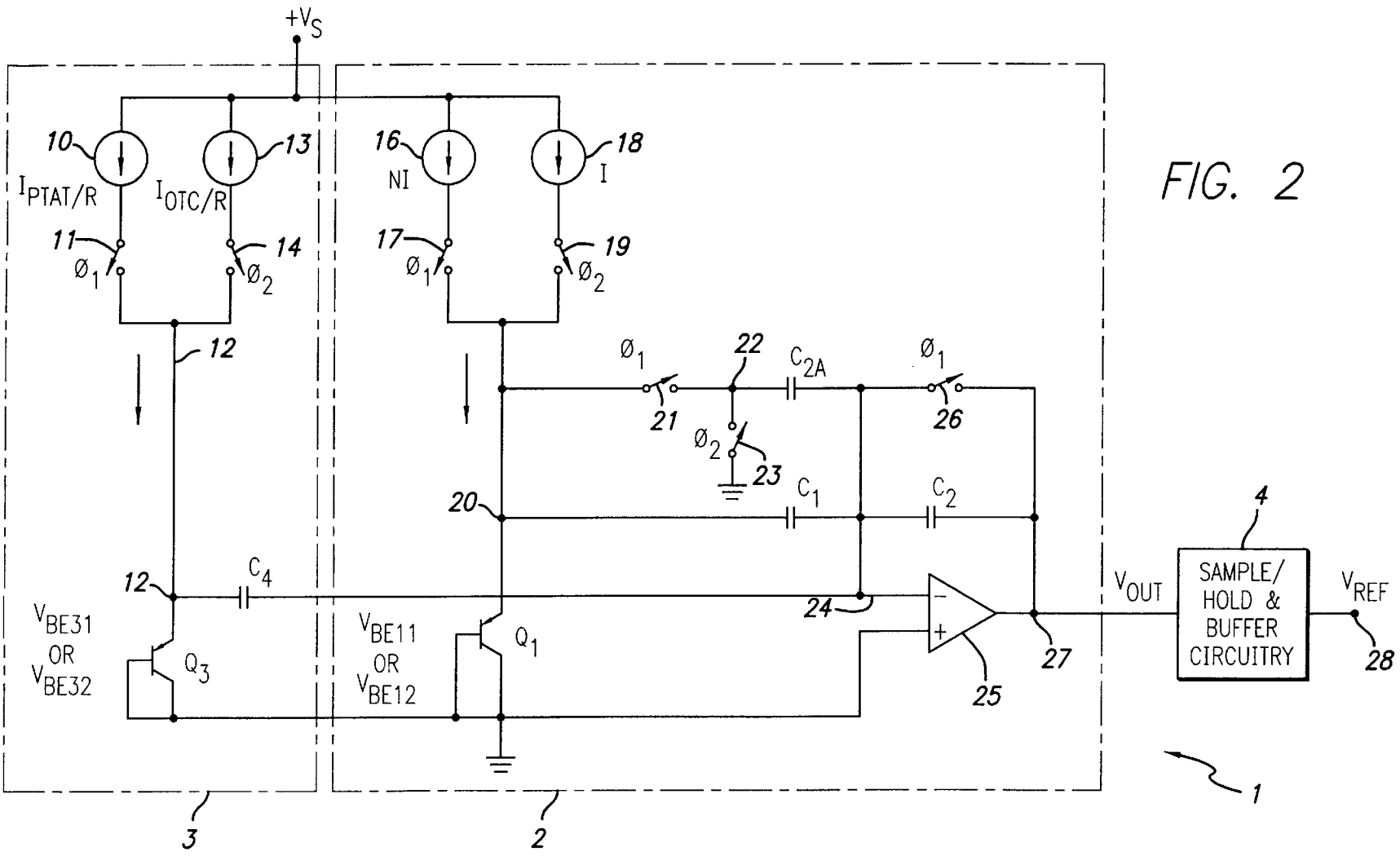
FIG. 2 is a diagram illustrating use of the curvature correction circuit of the present invention in conjunction with the prior art switched capacitor band gap reference circuit of FIG. 1.

Referring to FIG. 2, curvature-corrected switched capacitor reference band gap circuit 1 includes both the prior art switched capacitor band gap circuit 2 described above and a curvature compensation circuit 3. (Or, one of the switched capacitor band-gap reference voltage circuits shown in U.S. Pat. Nos. 5,563,504 and 4,375,595 could be used instead of the one shown in FIG. 2.) Curvature compensation circuit 3 includes a PTAT/R current source circuit 10 and a 0TC/R current source 13. A current produced by a PTAT (proportional to absolute temperature) voltage across a resistor is referred to as a PTAT/R current. Similarly, a current produced by an 0TC (zero temperature coefficient) voltage across a resister is referred to as a 0TC/R current.

PTAT/R current source 10 is connected between $+V_S$ and a first terminal of a switch 11 actuated by $\phi 1$. $\phi 1$ and $\phi 2$ are non-overlapping clock signals. The second terminal of switch 11 is connected by conductor 12 to a first terminal of a $\phi 2$-actuated switch 14, the second terminal of which is connected to 0TC/R current source 13. 0TC/R current source 13 is connected between $+V_S$ and second terminal of $\phi 2$-actuated switch 14. Conductor 12 is connected to the emitter of a diode-connected PNP transistor Q3, the base and collector of which are connected to ground. A capacitor C4 is connected between conductor 12 of curvature correction circuit 3 and the summing conductor 24 of prior art switched capacitor band gap circuit 2, as shown.

During "charging phase" $\phi 1$, switch 11 is closed and switch 14 is open, so the current flowing through transistor Q3 is equal to $I_{PTAT/R}$. This produces an emitter-base voltage $V_{BE31}$ on conductor 12 during $\phi 1$.

During "reference phase" $\phi 2$, switch 14 is closed and switch 11 is open, so the current through transistor Q3 is equal to $I_{OTC/R}$. At all temperatures (except one) $I_{PTAT}$ is different than $I_{OTC/R}$. So, when the current through diode Q3 is equal to $I_{OTC/R}$ during $\phi 2$, the voltage on conductor 12 is equal to $V_{BE32}$ which differs from $V_{BE31}$. In accordance with the present invention, this difference in voltage on conductor 12 is a $\Delta V_{BE3}$ curvature compensation voltage change that causes a curvature correction charge equal to $C_4(V_{B31}-V_{B32})$ of the correct polarity to be transferred from capacitor C4 via summing node 24 into feedback capacitor C2. The $\Delta V_{BE}$ curvature correction voltage change produced on conductor 12 and the corresponding curvature correction charge transferred into feedback capacitor C2 has a shape indicated by curve B in FIG. 8 that precisely matches the shape indicated by curve A in FIG. 8 of the residual band-gap curvature error of switched capacitor band-gap voltage reference circuit 2. Note that the capacitances of the various capacitors herein are indicated by the same alphanumeric characters used to designate the capacitors themselves. For example, C2 is the capacitance of capacitor C2, etc. The ratio of C2 to C4 provides a constant scale factor needed to provide almost exact curvature compensation of the voltage $V_{OUT}$ produced on conductor 27, as indicated by curve C in FIG. 8.

The operation of prior art switched capacitor band gap reference circuit 2 in FIG. 2 is that during charging phase $\phi 1$ the PTAT/R current NI develops a voltage $V_{BE11}$ across transistor Q1, so capacitors C1 and C2A are charged to $V_{BE11}$. Then, during reference phase $\phi 2$ the PTAT/R current I through transistor Q1 charges conductor 20 to $V_{BE12}$, causing capacitor C1 to transfer charge proportional to the change in the $V_{BE}$ voltage, i.e., $\Delta V_{BE1}$, of transistor Q1 to feedback capacitor C2. The difference $\Delta V_{BE1}$ between $V_{BE11}$ and $V_{BE12}$ is proportional to absolute temperature, since I and NI both are PTAT/R currents. The voltage $V_{BE11}$ stored on capacitor C2A during $\phi 1$ also is transferred to feedback capacitor C2 when switch 23 is closed during $\phi 2$. The above mentioned voltage change $\Delta V_{BE3}$ equal to $V_{BE31}-V_{BE32}$ on conductor 12 of curvature correction circuit 3 then superimposes the above mentioned curvature correction charge into the summing node 24 of operational amplifier 25 and hence into feedback capacitor C2 to correct the basic band-gap voltage developed on summing node 27 by the conventional switched capacitor band-gap voltage reference circuit 2.

As subsequently shown, the voltage $V_{OUT}$ on conductor 27 is given by the expression:

$$V_{OUT} = \frac{C_1}{C_2}(V_{BE11} - V_{BE12}) + \frac{C_{2A}}{C_2}V_{BE11} + \frac{C_4}{C_2}(V_{BE31} - V_{BE32}),$$

where the known switched capacitor voltage reference circuit 2 produces the first two terms on the right hand side of the above equation, and the curvature correction circuit 3 of the present invention provides the third term on the right hand side of the equation.

Figure 3A:
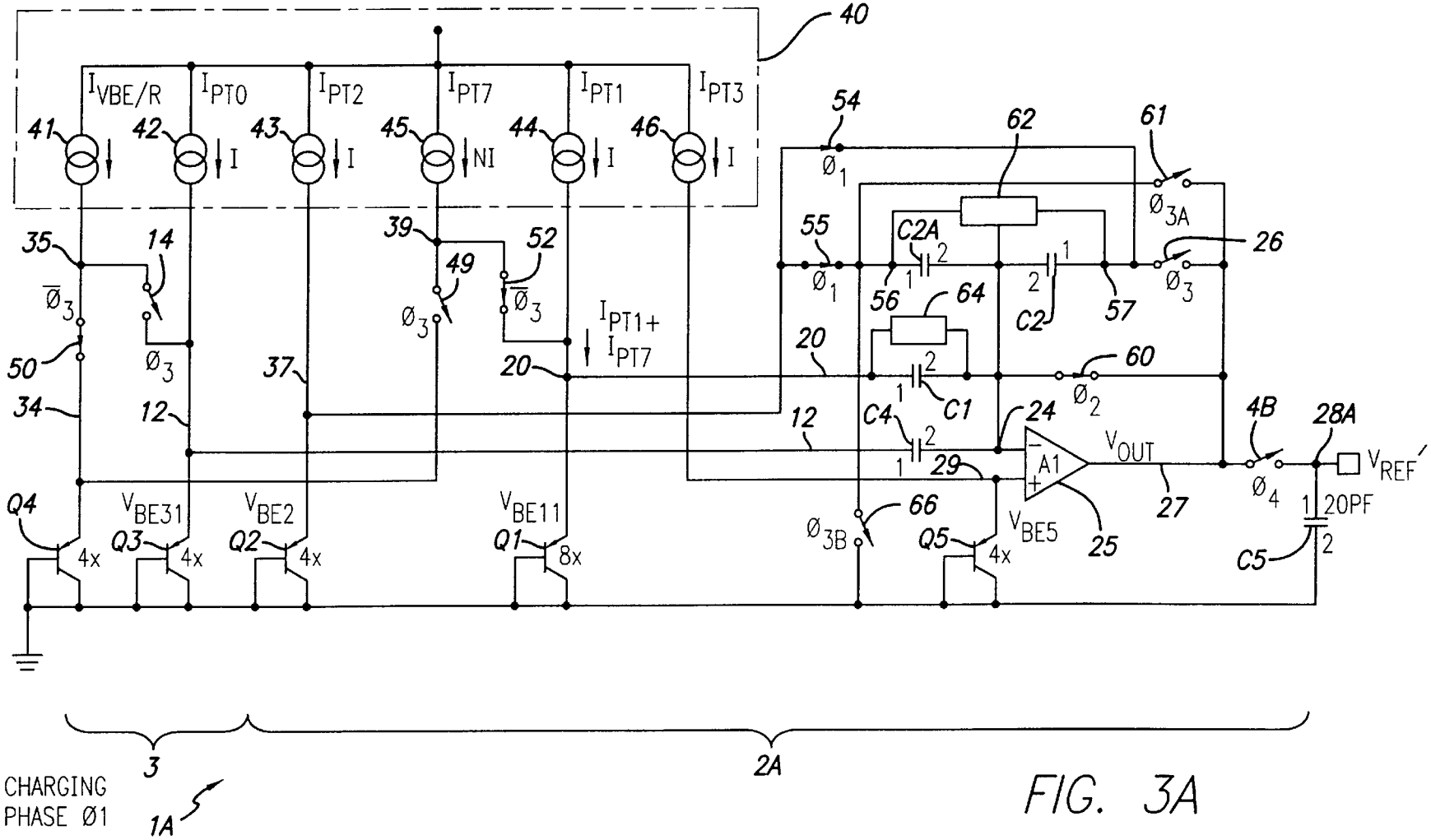
FIGS. 3A–3D each constitute the schematic diagram of the same preferred embodiment of the invention, but with different switch configurations to facilitate description of the operation during different phases.

FIG. 3A shows a simplified schematic diagram of the preferred embodiment of the invention including a different switched capacitor band gap reference circuit 2A that does not utilize the same transistor Q1 to develop both the required $V_{BE}$ and $\Delta V_{BE}$ signals, in contrast to the prior art circuit 2 of FIG. 2. Instead, the switched capacitor reference circuit 2A in FIG. 3A develops the $\Delta V_{BE}$ signal across transistor Q1 and develops the $V_{BE}$ signal across transistor Q2. Curvature correction circuit 3 is similar to the one in FIG. 2, except that current source 41 in FIG. 3A is a $V_{BE}$/R current source, rather than a 0TC/R current source such as current source 13 in FIG. 2. As subsequently explained, this is because in FIG. 3A current sources 41 and 42 can simultaneously flow through transistor Q3, whereas in FIG. 2 current sources 10 and 14 do not flow simultaneously through transistor Q3.

A diode-connected PNP transistor Q4 has its base and collector connected to ground and its emitter connected to conductor 34, to receive "dump" currents from current sources 41 and 45 when they are not switched into transistors Q3 and Q1, respectively. This keeps the current source terminals at about the same voltages for the various switch states, which may prevent undesirable variations in the output impedances thereof during the switching.

In FIG. 3A, switched capacitor band gap reference circuit 2A includes current source 43 conducting PTAT/R current $I_{PT2}$ of magnitude I continuously flowing through conductor 37 and diode-connected PNP transistor Q2 to ground. If switch 49 is closed and switch 52 is open, current source 45 conducts PTAT/R current $I_{PT7}$ of value 7I through conductor 39 and switch 49 to conductor 34 and through a transistor Q4 to ground. Current source 45 also supplies $I_{PT7}$ to transistor Q1 through conductor 39 and switch 52 to conductor 20 when switch 49 is open and switch 52 is closed. Current source 44 continuously supplies PTAT/R current $I_{PT1}$ of value I through conductor 20 and through diode-connected transistor Q1 to ground if switch 52 is open. Thus, if switch 52 is closed and switch 49 is open, then $I_{PT1}+I_{PT7}$ flows through transistor Q1 to ground.

Current source 46 supplies PTAT/R current $I_{PT3}$ through conductor 29 and diode-connected PNP transistor Q5 to ground to continuously bias the (+) input of operational amplifier 25 to the emitter-base voltage $V_{BE5}$ of transistor Q5, to equalize the voltages on switches 55 and 26 so as to balance charge injection effects. (Alternatively, conductor 29 could be biased to any other convenient fixed reference voltage. For example, conductor 29 could be connected to conductor 37, in which case transistor Q5 could be eliminated.)

Conductor 12 of curvature correction circuit 3 is connected to the left terminal of capacitor C4, the right terminal of which is connected by summing conductor 24 to the (−) input of operational amplifier 25, to the left terminal of switch 60, and to one terminal of each of capacitors C1, C2, and C2A.

The left terminal of capacitor C1 is connected to conductor 20. The left terminal of capacitor C2A is connected to the left terminal of switch 61, the right terminal of switch 55, and to one terminal of switch 66. The other terminal of switch 66 is connected to ground. The left terminal of switch 55 is connected to conductor 37. The right terminal of capacitor C2 is connected to the left terminal of switch 26 and the right terminal of switch 54.

The output of operational amplifier 25 produces $V_{OUT}$ on conductor 27, which is connected to the left terminal of switch 4B, the right terminal of switch 60, and the right terminals of switches 26 and 61. The right terminal of switch 4B is connected by conductor 28A to one terminal of capacitor C5, the other terminal of which is connected to ground. The reference voltage $V_{REF}$ is produced on conductor 28A by the sample/hold circuit including sampling switch 4B and capacitor C5.

Note that the $\Delta V_{BE}$ voltage referred to above is produced across the emitter-base junction of transistor Q1, but the $V_{BE}$ voltage referred to above is produced across the emitter-base junction of transistor Q2 rather than transistor Q1 as in FIG. 2. The voltage $V_{BE2}$ across transistor Q2 can be the same as or different than either of the voltages $V_{BE11}$ (FIG. 3A) or $V_{BE12}$ (FIG. 3C) produced across transistor Q1.

$I_{PT0}$, $I_{PT1}$, $I_{PT2}$, $I_{PT3}$, $I_{PT4}$, and $I_{PT5}$ all are scaled to have a value I of approximately 5 microamperes. $I_{PT7}$ is scaled to have a value 7I of approximately 35 microamperes. $I_{VBE/R}$ is scaled to provide a $V_{BE/R}$ current of 5 microamperes to be added to $I_{PT0}$ In FIG. 3A, switches 54 and 55 are actuated by "charging phase" signal $\phi 1$. Switch 60 is actuated (i.e., turned on) by a "settling phase" signal $\phi 2$. Switches 14, 50, 49, 52, 26 and one of 61 and 66 are actuated or turned on by a "reference phase" signal $\phi 3$. Switch 4B is turned on by an "update phase" signal $\phi 4$.

The $V_{BE}$/R current source 41 and PTAT/R current sources 42–46 included within dotted line 40 in FIG. 3A are shown in more detail in the diagram of FIG. 5, subsequently described. The details of operational amplifier 25 are shown in more detail in FIG. 6.

The operation of the circuit of FIG. 3A is described with reference to FIGS. 3A–3D, which show the switch configurations for the $\phi 1$, $\phi 2$, $\phi 3$ and $\phi 4$ phases, respectively.

FIG. 3A shows the configuration of the various switches for charging phase $\phi 1$, as shown in FIG. 8. During charging phase $\phi 1$, switch 49 is open and switches 52 and 60 are closed, so the PTAT/R current $I_{PT1}+I_{PT7}$ is equal to 8I, which flows through conductor 20 and transistor Q1 to ground to produce the voltage $V_{BE11}$ across the emitter-base junction of transistor Q1. The PTAT/R current $I_{PT2}$ of value I flows through conductor 37 and transistor Q2. (I can be 5 microamperes.) PTAT/R current $I_{PT0}$ of value I flows from current source 42 through transistor Q3 to ground, producing a voltage $V_{BE31}$ across its emitter-base junction.

With switch 14 open and switch 50 closed, a $V_{BE/R}$ current $I_{VBE/R}$ flows from current source 41 through transistor Q4 to ground. $I_{VBE/R}$ is a $V_{BE/R}$ current, rather than a 0TC/R current such as current source 13 of FIG. 2. (A $V_{BE/R}$ current is one established by applying a transistor $V_{BE}$ voltage across a resistor of resistance R, and hence has the same temperature coefficient as the $V_{BE}$ voltage.) Note that in FIG. 2, either switch 11 is on, directing $I_{PTAT/R}$ through transistor Q4, or switch 14 is on, directing $I_{PTAT/R}$ through transistor Q4, but they are never simultaneously on. In contrast, in FIG. 3A either the PTAT/R current of current source 42 (which corresponds to current source 10 in FIG. 3) flows through transistor Q3 or the currents of both PTAT/R current source 42 and $V_{BE}$/R current source 41 flow through transistor Q3. Therefore, to get a zero temperature coefficient of the current flowing through transistor Q4 during ϕ3 in FIG. 3A, it is necessary to use a $V_{BE}$/R rather than a 0TC/R current for current source 41.

The PTAT/R current $I_{PT3}$ of value I from current source 46 flows through level shifting transistor Q5, to level-shift the inputs of operational amplifier 25 to the $V_{BE5}$ voltage of transistor Q2, through which PTAT/R current $I_{PT2}$ of value I flows. This results in matching of the charge injection of switches 54 and 55 with the charge injection of switch 60, and also avoids the requirement that the output $V_{OUT}$ on conductor 27 of amplifier 25 swing to zero volts when it is connected as a follower for offset correction and pre-charging, as subsequently described. At the end of charging phase ϕ1, capacitor C1 is charged to $V_{BE11}-V_{BE5}$, capacitors C2 and C2A are charged to $V_{BE2}-V_{BE5}$, and capacitor C4 is charged to $V_{BE31}-V_{BE5}$.

Figure 3B:
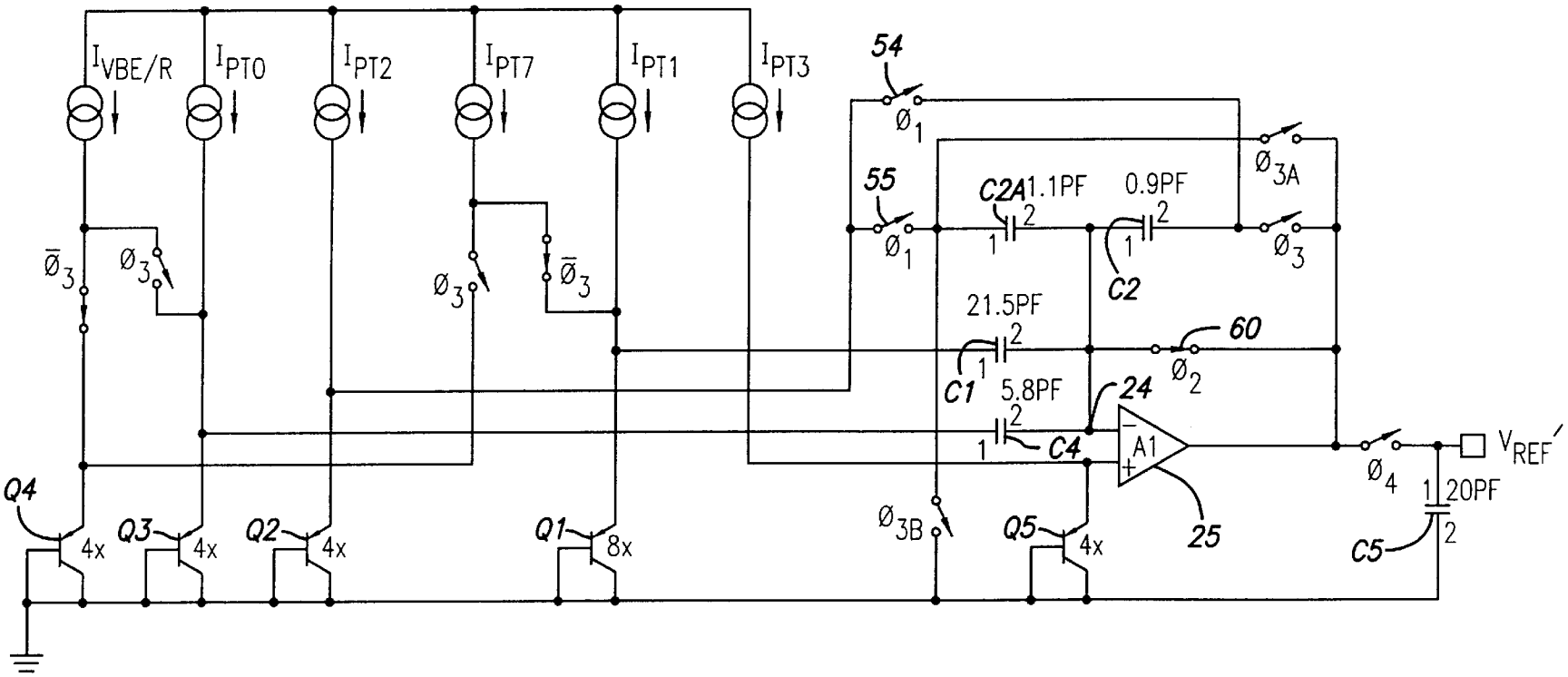

Referring to FIG. 3B, during "settling phase" ϕ2, switches 54 and 55 are opened to sample $V_{BE2}$, and switch 60 remains closed. The transient which occurs on conductor 24 at the trailing edges of ϕ1 (because of the switching that occurs there) is allowed to settle during ϕ2, as shown in FIG. 8, so that the transient does not disturb the generation of a $\Delta V_{BE}$ voltage on transistor Q1. This is important to obtaining accurate reproduction of the $\Delta V_{BE}$ voltage across transistor Q1, because when switches 54 and 55 are opened they couple charge through capacitances C2A and C2 into summing node 24. That causes a change in the voltage on summing node 24. This is shown by the "node 24" waveform in FIG. 7, and it perturbs the charges in capacitors C1 and C4. Since the $\Delta V_{BE}$ curvature correction voltage that is to be coupled by capacitor C4 into summing node 24 and feedback capacitor C2 is a critical part of the curvature corrected band gap voltage, it is desirable to let that variation on node 24 settle. (Alternatively, settling phase ϕ2 could be omitted in some cases, for example as in the embodiment of FIG. 2, wherein the reference phase ϕ2 is the same as the reference phase ϕ3 for FIGS. 3A–3C. Note that one of switches 66 and 61 (FIG. 3A) is closed, depending on which of the subsequently described operating or trim modes of operation is being performed.

Figure 3C:
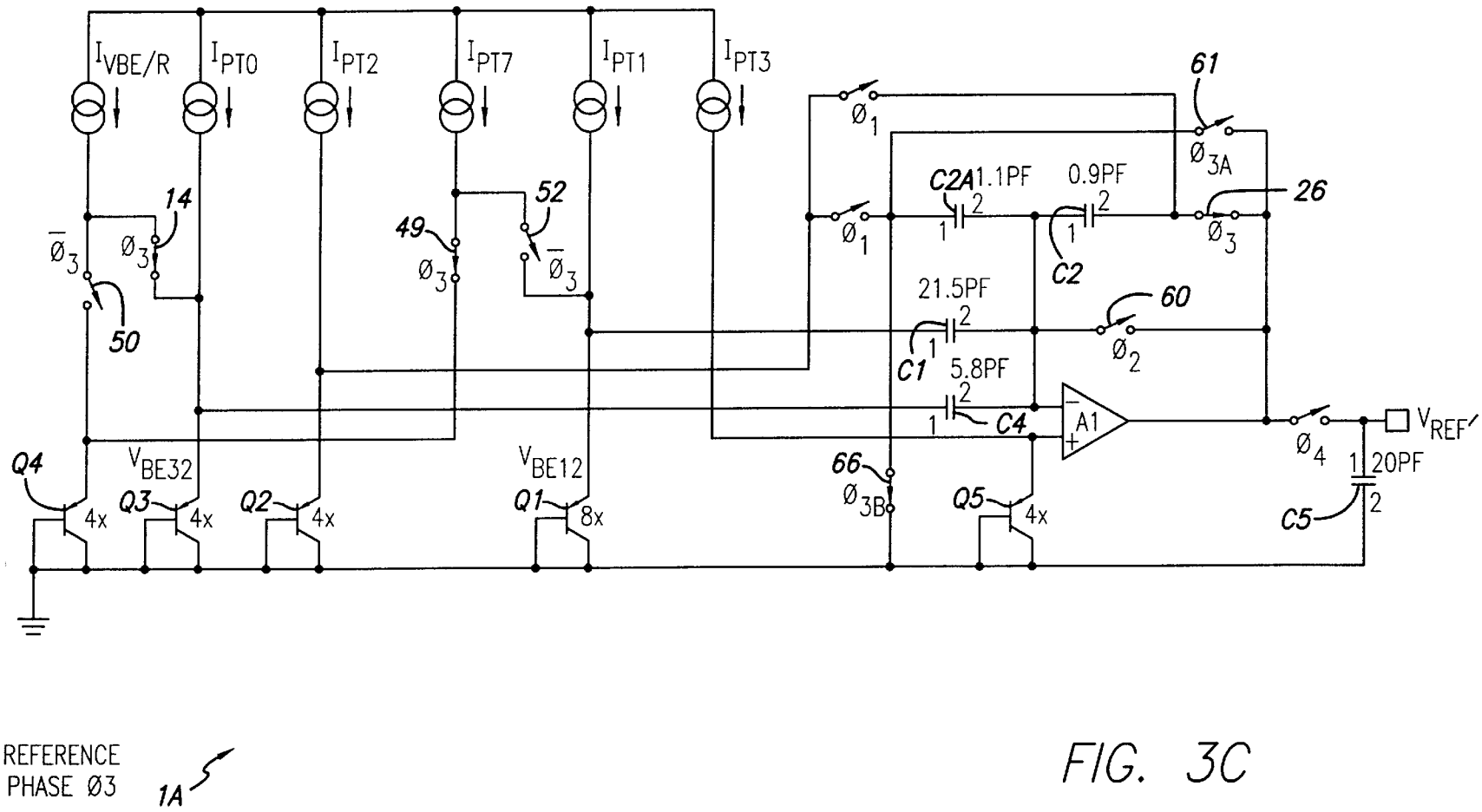
Figure 3D:
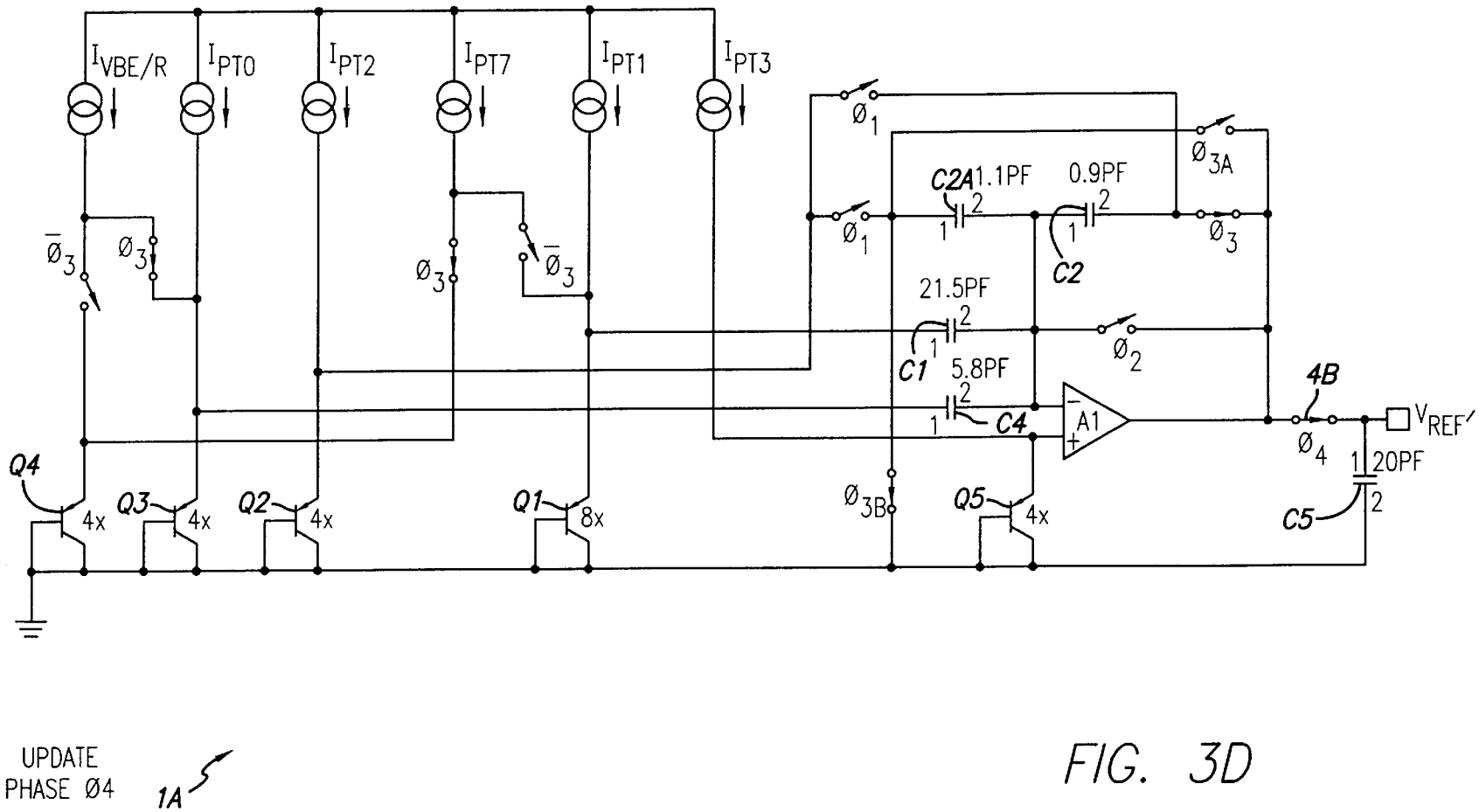

Referring to FIG. 3C, switch 60 is opened and switch 26 is closed during reference phase ϕ3 as shown. Switch 52 is opened and switch 49 is closed, so the current $I_{PT1}$ provides a PTAT/R current I through transistor Q1, resulting in the voltage $V_{BE12}$ across its emitter-base junction. Switch 50 is opened and switch 14 is closed, so the current $I_{PT0}+I_{VBE/R}$ provides a 0TC/R current through transistor Q3, producing the voltage $V_{BE32}$ across its emitter-base junction. If switch 66 is closed, capacitor C2A is charged to $-V_{BE5}$ volts. The PTAT/R current $I_{PT1}$ of value I flows through transistor Q1, producing thereon an emitter-base voltage $V_{BE12}$. During reference phase ϕ3, capacitor C2 is connected as a feedback capacitor for amplifier 25, and therefore receives transfer charges from capacitors C1, C4 and C2A as a result of operational amplifier 25 varying $V_{OUT}$ to maintain the (−) and (+) inputs thereof at the same virtual ground voltage $V_{BE5}$.

During normal operation, switch 61 is open, and switch 66 is closed during ϕ3 by clock signal ϕ3B to transfer the charge in capacitor C2A into feedback capacitor C2 to increase $V_{OUT}$ to a value equal to a scale factor determined by C2A multiplied by the band gap voltage. (The actual scale factor is equal to 1+C2A/C2.) However, during one of the trim operations subsequently described, switch 66 is opened and switch 61 is closed to connect capacitor C2A in parallel with feedback capacitor C2, while capacitor C1 is trimmed to adjust the voltage $V_{OUT}$ on conductor 27 to a value precisely equal to the band gap voltage of silicon, so the temperature coefficient of $V_{OUT}$ will be zero.

By the end of reference phase ϕ3, capacitor C1 is charged to $V_{BE12}-V_{BE5}$, and capacitor C4 is charged to $V_{BE32}-V_{BE5}$. Feedback capacitor C2 initially holds the charge corresponding to $V_{BE32}-V_{BE5}$ from the ϕ2 settling phase, and now receives additional transfer charges from capacitors C1, C2A and C4 based on the differences in charges transferred to capacitor C2 between the end of settling phase ϕ2 and the end of reference phase ϕ3. Specifically, capacitor C2 receives transfer charges C1·($V_{BE11}-V_{BE2}$), C2A·($V_{BE2}$), and C4 ($V_{BE31}-V_{BE32}$). Accordingly, the voltage across feedback capacitor C2 is given by the equation:

$$V_{BE2} - V_{BE5} + \frac{C1\cdot(V_{BE11} - V_{BE12}) + C2A\cdot V_{BE2} + C_4\cdot(V_{BE31} - V_{BE32})}{C2}. \quad \text{(Eq. 1)}$$

This results in a voltage $V_{OUT}$ on conductor 27 at the output of amplifier 25 of:

$$V_{OUT} = \frac{(C2 + C2A)\cdot V_{BE2} + C1\cdot(V_{BE11} - V_{BE12}) + C4\cdot(V_{BE31} - V_{BE32})}{C2}. \quad \text{(Eq. 2)}$$

Note that neither $V_{BE5}$ nor the amplifier offset voltage $V_{OS}$ appears in the expression for the output voltage $V_{OUT}$. That is because the offset voltage of operational amplifier 25 is automatically cancelled by the above described switching technique. The cancellation occurs because feedback capacitor C2 is connected between conductor 37 and summing conductor 24 during charging phase ϕ1. This causes capacitor C2 to be charged to $V_{BE2}$ minus the "virtual" voltage on summing conductor 24. The virtual voltage on summing conductor 24 is equal to $V_{BE5}+V_{OS}$. Then, during reference phase ϕ3 feedback capacitor C2 is connected between summing conductor 24 and operational amplifier output conductor 27, which cancels both the offset voltage $V_{OS}$ and $V_{BE5}$.

It is noteworthy that Eq. 2 has the appropriate form for a band-gap voltage reference circuit having curvature correction, wherein the sum of the capacitances of feedback capacitor C2 and capacitor C2A constitutes a scaling factor of the $V_{BE}$ voltage produced across the emitter-base junction of transistor Q2. The capacitance of capacitor C1 is a scale factor for the $\Delta V_{BE}$ voltage produced across transistor Q1. C4 constitutes a scale factor for the curvature correction term $\Delta V_{BE}$ developed across the emitter-base junction of transistor Q3 during the switching between ϕ2 and the end of ϕ3. The capacitance of capacitor C2 is a scale factor for the magnitude of $V_{OUT}$.

During "update phase" ϕ4, switch 4B is closed to allow the output voltage $V_{OUT}$ of operational amplifier 25 to be updated onto a hold capacitor C5. The foregoing sequence of $\phi 1$, $\phi 2$, $\phi 3$ and $\phi 4$ may be repeated indefinitely.

Figure 4:
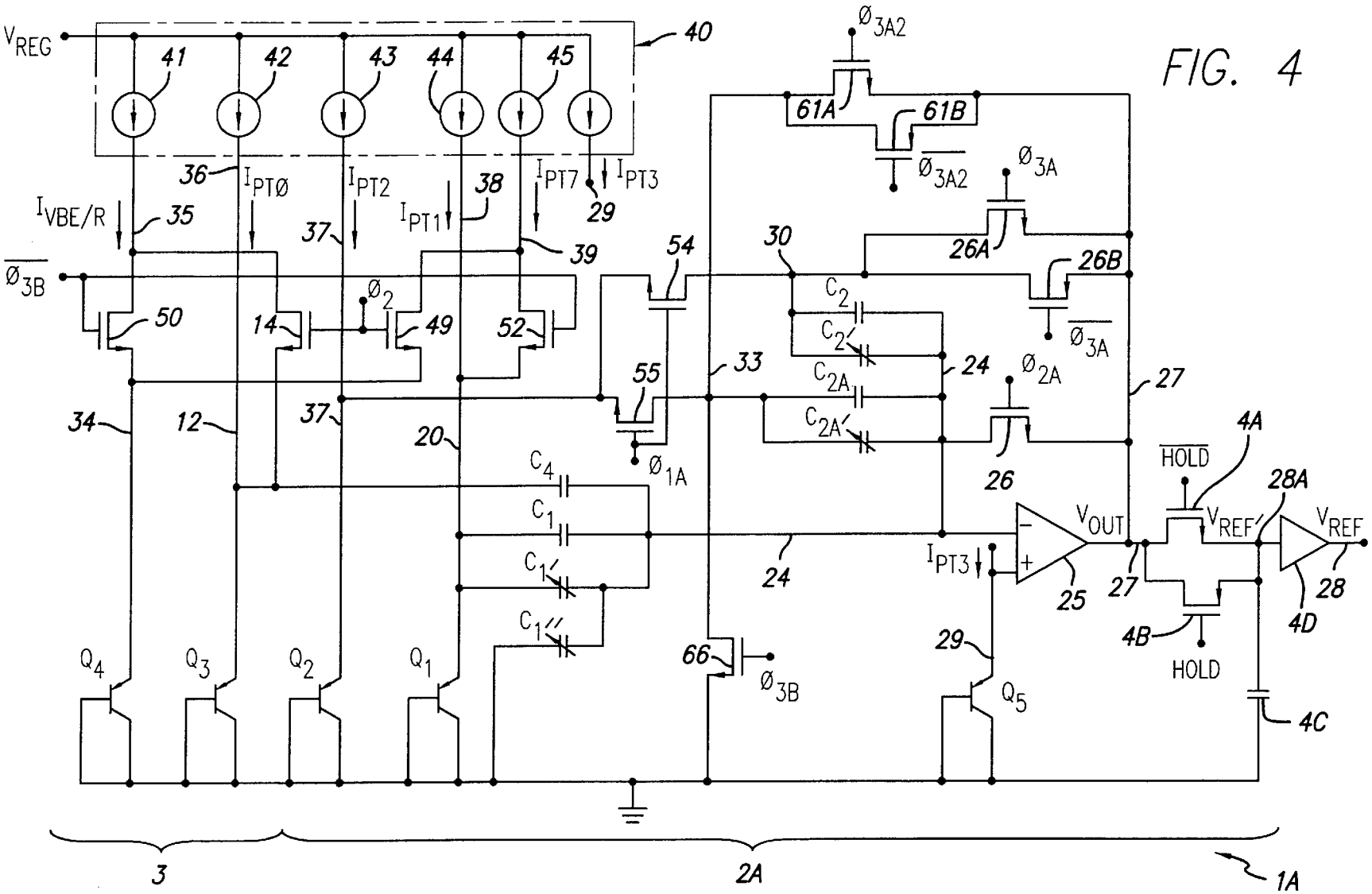
FIG. 4 is a detailed circuit schematic of a particular implementation of the embodiment disclosed in FIGS. 3A–D.

FIG. 4 shows a more detailed implementation of the circuit shown in FIGS. 3A–D. The current sources shown in block 40 are the same as in FIGS. 3A–D. The various switches shown in FIGS. 3A–D are implemented by various MOSFETs designated by the same or similar reference numerals. In FIG. 4, additional trim capacitors C1', C1", C2' and C2A' are illustrated. A suitable buffer circuit 4D has its input connected to conductor 28A, and its output produces the curvature-corrected output reference voltage $V_{REF}$ on conductor 28. Buffer circuit 4D preferably is capable of driving a resistive load and/or a large load capacitance of 1–10 microfarads.

Capacitor C1 is adjusted by adjusting trimmable capacitors C1' and C1" in FIG. 4 so as to cause switched capacitor band gap reference circuit 1A to have zero drift value. This can be accomplished by selection of trim capacitor values from an array of capacitors represented in FIG. 4 by trimmable capacitors C1' and C1" that are selectively added to or removed from the effective capacitance of capacitor C1. Capacitor C1 may be trimmed electronically through a digital interface to the digital register or, for example, by cutting polycrystaline silicon resistor links with a laser beam. This can be accomplished by using digital data to control the trim by selecting capacitors from a trim array. Similarly, the output voltage $V_{OUT}$ is adjusted by adjusting the effective values of capacitors C2 and C2A by trimming the values of adjustable capacitors C2' and C2A'.

Referring again to FIG. 3A, during the manufacturing process capacitor C1 is trimmed first. The clock signal $\phi_{3A}$ is set to a "1" during $\phi_3$ so that switch 61 in FIG. 3A (switches 61A and 61B in FIG. 4) is turned on (i.e., closed). The clock signal $\phi_{3B}$ is set to a "0" during $\phi_3$ so that switch 66 is turned off (i.e., opened). Switch 26 is turned on. This connects capacitors C2 and C2A in parallel as a feedback network for amplifier 25. Capacitor C1 then is trimmed by providing an 8-bit digital word as an input to a capacitance trimming array 64 shown in FIG. 3A. The structure and operation of the capacitance trimming array 64 is subsequently described with reference to FIG. 10. Capacitor C1 is trimmed so as to set the voltage $V_{OUT}$ on conductor 27 to a value commonly referred to by those skilled in the art as the "magic number" approximately equal to the band gap voltage of silicon.

After the band gap voltage has been precisely established by trimming of C1 as described above, then $\phi_{3B}$ is set to a "1" and $\phi_{3A}$ is set to a "0" during phase $\phi_3$, so that switch 61 is opened and switch 66 is closed. Then only feedback capacitor C2 is connected as a feedback network of amplifier 25. The closing of switch 66 causes capacitor C2A to function as a gain scaling capacitor so that the value of $V_{OUT}$ is equal to the product of a scaling factor (1+C2A/C2) determined by the capacitance of C2A multiplied by the established "magic number" band gap voltage achieved by the prior trimming of capacitor C1. This is true only if the sum of C2 and C2A is maintained constant. Capacitor C2A is trimmed by providing an 8-bit digital word as an input to trim array 62, which is shown in FIG. 10.

Capacitor C2 is simultaneously trimmed with capacitor C2A using trim array 62 such that the sum of the trimmed capacitors C2A and C2 is constant. The capacitance trim circuit array 62 of FIG. 10 accomplishes trimming of capacitors C2 and C2A such that the sum of their capacitances is constant by shifting the capacitance "trimmed" from one of C2 and C2A to the other.

Figure 10:
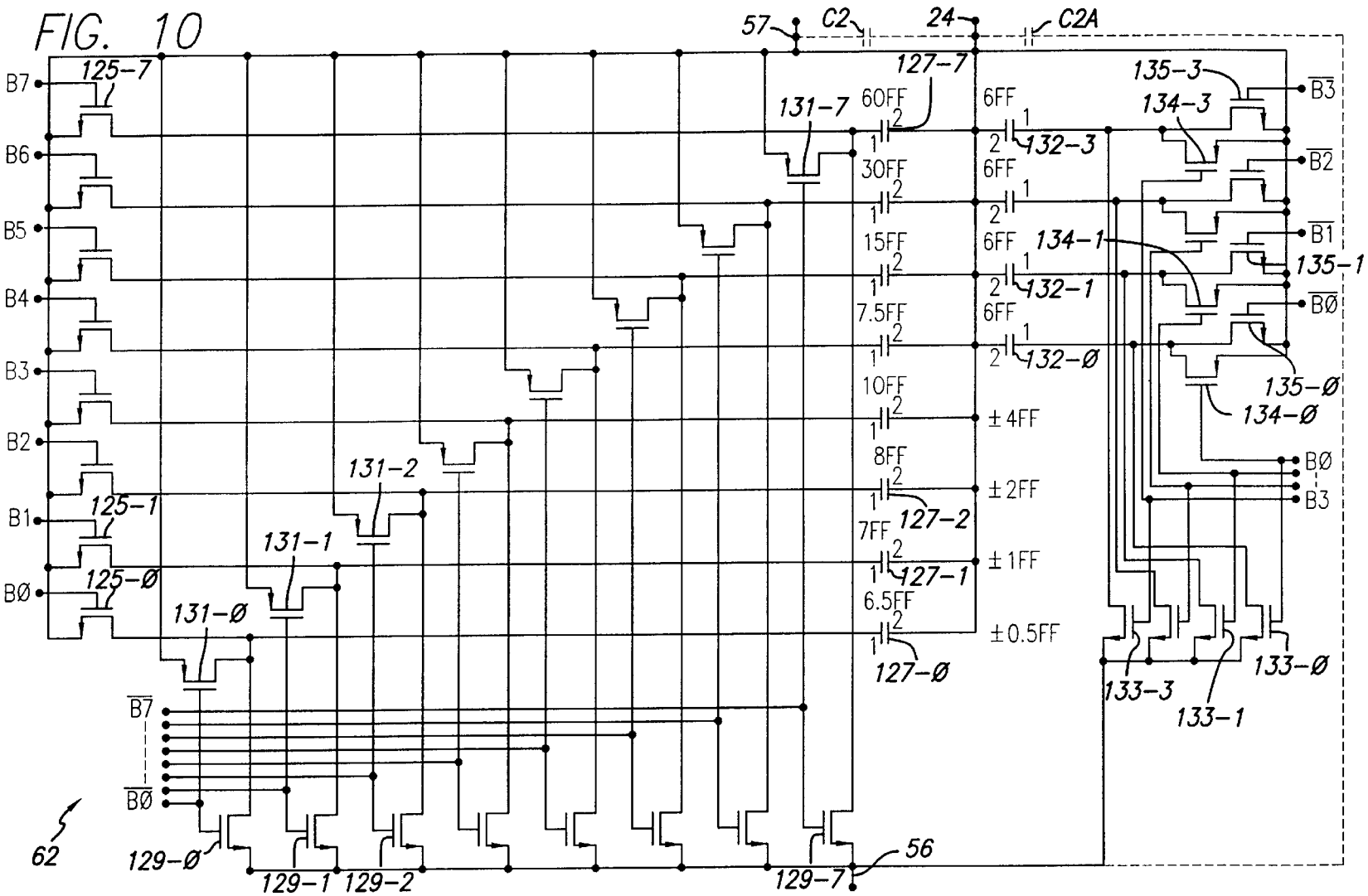
FIG. 10 is a diagram of a capacitor trimming circuit that allows trimming of capacitor C1 in FIG. 3A with a resolution of 0.5 femtofarads.

Referring to FIG. 10, capacitance trim array 62 includes three terminals which are connected to conductors 24, 56, and 57, respectively, in FIG. 3A. The connections of capacitors C2 and C2A to conductors 24, 56, and 57 in FIG. 3A are indicated by dotted lines in FIG. 10. Eight N-channel MOSFETs 125-0,1 . . . 7 have their source electrodes connected to conductor 57. Their gates are connected to the B0,1 . . . 7 outputs, respectively, of a data register which is loaded with a digital word indicating the amount of capacitance trimming required. The desired trim code B0,1 . . . 7 can be permanently "burned in" using various well known techniques. The assignee of the present application accomplishes this by laser cutting of polycrystaline silicon conductors to establish the values of B0,1 . . . 7. The drain electrodes of MOSFETs 125-0,1 . . . 7 are connected to the first plates of capacitors 127-0,1 . . . 7, respectively, and also to the drain electrodes of P-channel MOSFETs 131-0,1 . . . 7, respectively, and also to the drain electrodes of N-channel MOSFETs 129-0,1 . . . 7, respectively.

Note that each of the capacitors 127-0,1 . . . 7 and 132-0,1 . . . 3 has a "first plate" with an adjacent numeral "1" and a "second plate" with an adjacent numeral "2". The second plates of capacitors 127-0,1 . . . 7 are connected to conductor 24. The source electrodes of MOSFETs 131-0,1 . . . 7 are connected to conductor 57. The source electrodes of MOSFETs 129-0,1 . . . 7 are connected to conductor 56. The digital signals $\overline{B0}$, $\overline{B1}$ . . . $\overline{B7}$ are connected to the gate electrodes of MOSFETs 131-0,1 . . . 7 respectively, and also to the gate electrodes of MOSFETs 129-0,1 . . . 7, respectively. The corresponding pairs of N-channel MOSFETs 125-0,1 . . . 7 and P-channel MOSFETs 131-0,1 . . . 7 form eight CMOS transmission gate switches between conductor 57 and the first plates of capacitors 127-0,1 . . . 7, respectively. Capacitors 127-0,1 . . . 7 have capacitances of 6.5, 7, 8, 10, 7.5, 15, 30, and 60 femtofarads (FF), respectively.

Conductor 24 is connected to the second plates of capacitors 132-0,1 . . . 3, each of which has a capacitance of 6 FF. The first plates of capacitors 132-0,1 . . . 3 are connected to the drain electrodes of P-channel MOSFETs 134-0,1 . . . 3, respectively, to the drain electrodes of N-channel MOSFETs 135-0,1,2 . . . 3, respectively, and to the drain electrodes of N-channel MOSFETs 133-0,1 . . . 3, respectively. The source electrodes of MOSFETs 135-0,1 . . . 3 and the source electrodes of MOSFETs 134-0,1 . . . 3 are connected to conductor 24. The gate electrodes of MOSFETs 135-0,1 . . . 3 are connected to the digital signals $\overline{B0}$, $\overline{B1}$, $\overline{B2}$, and $\overline{B3}$, respectively. The source electrodes of MOSFETs 133-0,1 . . . 3 are connected to conductor 56. The digital signals B0, B1 . . . B3 are connected to the gate electrodes of MOSFETs 134-0,1 . . . 3, respectively, and to the gate electrodes of MOSFETs 133-0,1 . . . 3, respectively. The corresponding pairs of N-channel MOSFETs 134-0,1 . . . 3 and P-channel MOSFETs 134-0,1 . . . 3 form four CMOS transmission gate switches between conductors 57 and the first plates of capacitors 132-0,1 . . . 3, respectively.

If any of the signals B0,1 . . . 7 is switched to a "1", that turns a corresponding one of N-channel MOSFETs 125-0,1 . . . 7 on, and a complementary "0" level turns on the P-channel MOSFET of the corresponding CMOS transmission gate; the same "0" level turns off the corresponding one of N-channel MOSFETs 129-1, . . . 7. This connects the corresponding one of capacitors 127-0,1 . . . 7 in parallel with capacitor C2, and removes it from being connected in parallel with capacitor C2A. Similarly, if any of B0,1 . . . 7 is switched to a "0", that turns a corresponding one of N-channel MOSFETs 129-0,1 . . . 7 on, and the corresponding one of MOSFETs 125-0,1 . . . 7 will be turned off. That connects the corresponding one of capacitors 127-0,1 . . . 7 in parallel with capacitor C2A and removes it from being connected in parallel with capacitor C2.

Thus, the total trim capacitance of capacitors 127-0,1 . . . 7 is always distributed among capacitors C2 and C2A, so that the sum of the capacitances of capacitors C2 and C2A is constant and is unchanged by the trimming because the trimming switches various ones of trim capacitors 127-0,1 . . . 7 from being connected in parallel with one of capacitors C2 and C2A to being connected in parallel with the other.

Similarly, the total trim capacitance of capacitors 132-0,1 . . . 3 is always distributed among capacitors C2 and C2A, so the total capacitance of capacitors C2 and C2A is unaffected by switching any of trim capacitors 132-0,1 . . . 3 from being in parallel with one of capacitors C2 and C2A to being connected in parallel with the other.

The four least significant bits B0,1,2,3, in effect, allow a net differential amount of capacitance equal to the difference between two capacitors to be switched in parallel with either of capacitors C2 and C2A. If any of B0, B1, B2, or B3 is switched to a "1", then 6.5, 7, 8, or 10 FFs of capacitance of a corresponding one of capacitors 127-0,1,2,3 is switched from being connected in parallel with capacitor C2A to being connected in parallel with capacitor C2. At the same time, the 6 FF capacitance of the corresponding one of capacitors 132-0,1,2,3 is switched from being connected in parallel with capacitor C2 to being connected in parallel with capacitor C2A. Thus, the relatively small differential amount of capacitance between the one of capacitors 127-0,1,2,3 switched to being connected in parallel with capacitor C2 and the corresponding one of capacitors 132-0,1,2,3 switched to being not connected in parallel with capacitor C2 is in effect added to the capacitance of capacitor C2.

Similarly, if any of B0, B1, B2, or B3 is switched to a "0", then 6.5, 7, 8, or 10 FFs of capacitance of a corresponding one of capacitors 127-0,1,2,3 is switched from being connected in parallel with capacitor C2 to being connected in parallel with capacitor C2A. At the same time, the 6 FF capacitance of the corresponding one of capacitors 132-0,1,2,3 is switched from being connected in parallel with capacitor C2A to being connected in parallel with capacitor C2. Thus, the relatively small differential amount of capacitance between the one of capacitors 127-0,1,2,3 switched away from being connected in parallel with capacitor C2 and the corresponding one of capacitors 132-0,1,2,3 switched to being connected in parallel with capacitor C2 is in effect subtracted from the capacitance of capacitor C2. It should be noted that individual polycrystaline silicon capacitors of capacitance less than approximately 3 to 5 FF can not be manufactured with the manufacturing process used for making the curvature corrected switch capacitor band gap circuit described herein. Therefore, the above differential capacitive switching circuit and technique provides the advantage of effective trimming of the capacitance of polycrystaline silicon capacitors with a resolution of approximately 0.5 FFs by "differential" switching of amounts of capacitance as low as 0.5 FF to or away from a circuit node.

By maintaining the sum of the capacitances of capacitors C2 and C2A constant, the temperature drift of $V_{OUT}$ is independent of the output voltage. The can be accomplished by simultaneously trimming capacitors C2 and C2A.

Figures 5, 9:
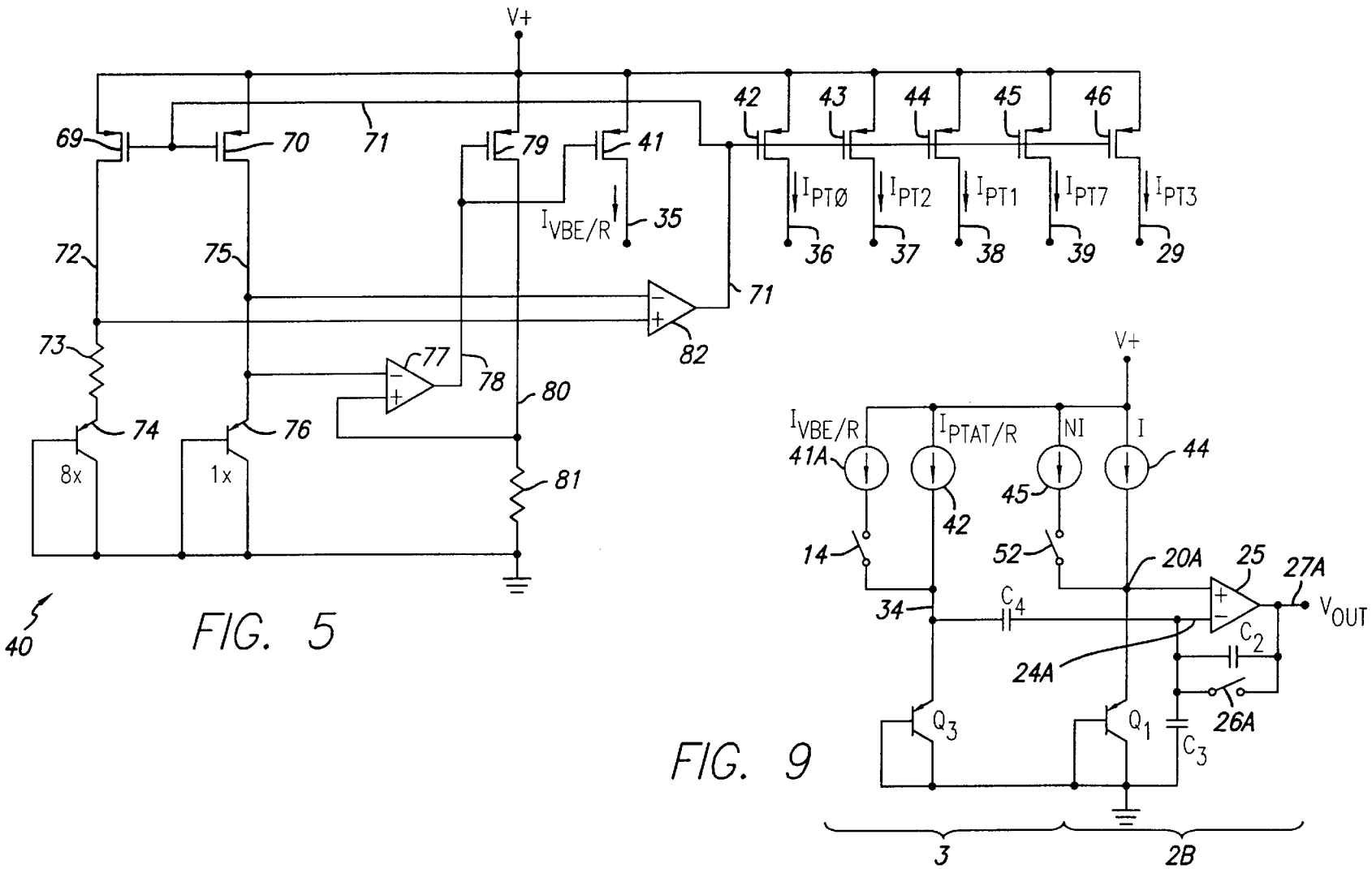
FIG. 5 is a schematic drawing of the switched current source circuitry contained in block 40 of FIG. 4.
FIG. 9 is a schematic diagram of an alternative embodiment of the invention.

Referring to FIG. 5, the current source circuit 40 of FIG. 4 is shown in more detail. Current source circuit 40 provides the various PTAT/R and $V_{BE}$/R currents required by curvature-corrected switched capacitor reference circuit 1A. Current source generator 40 includes P-channel MOSFETs 69, 70, 79, 41, 42, 43, 44, 45 and 46 all having their source electrodes connected to a reference voltage V+. MOSFETs 41–46 correspond to current sources 41–46 in FIGS. 3A–D. The gate electrodes of MOSFETs 69, 70, and 42–46 are connected by conductor 71 to the output of an operational amplifier 82. The gate electrodes of MOSFETs 79 and 41 are connected by conductor 78 to the output of a second operational amplifier 77. The drain electrodes of MOSFETs 41–46 are connected to conductors 35, 36, 37, 38, 39, and 29, respectively. The drain electrode of MOSFET 69 is connected by conductor 72 to the (+) input of operational amplifier 71 and to one terminal of resistor 73. The other terminal of resistor 73 is connected to the emitter of a PNP diode-connected PNP transistor 74, the collector and base of which are connected to ground. The drain of MOSFET 70 is connected by conductor 75 to the (−) input of operational amplifier 82, the (−) input of operational amplifier 77, and to the emitter of a diode-connected PNP transistor 76, the base and collector of which are connected to ground. The drain of MOSFET 79 is connected by conductor 80 to the (+) input of operational amplifier 77 and to one terminal of resistor 81, the other terminal of which is connected to ground. Current source circuit 40 of FIG. 5 also provides the PTAT/R bias currents (not shown) needed by operational amplifier 25.

In circuit 40 of FIG. 5 MOSFETs 69 and 70 maintain equal currents through transistors 74 and 76. The emitter area of transistor 74 is 8 times that of transistor 76, and operational amplifier 82 provides feedback to the gate of MOSFETs 69 and 70 to keep conductors 72 and 75 at identical voltages. Therefore, a PTAT $\Delta V_{BE}$ voltage difference is developed across resistor 73 and a PTAT/R current flows through MOSFET 69, and hence through current mirror output MOSFETs 42–46 (because they are all driven by the same gate-to-source voltage). Operational amplifier 77 servos the voltage across resistor 81 to be equal to $V_{BE}$ current which generates a $V_{VBE/R}$ current which is mirrored from MOSFET 79 to MOSFET 41 through which $I_{VBE/R}$ flows.

Referring to FIG. 6, operational amplifier 25 is a simple single-stage folded cascode amplifier using P-channel MOSFET input devices. The circuitry designated by numeral 25A constitutes the ordinary folded cascode operational amplifier, and the circuitry 25B constitutes bias circuity for generating the bias voltages required. The gates of MOSFETs 90, 96, 103 and 106 are connected to power down control signals (not shown) to shut the circuit down during a power down mode.

The illustrated architecture was chosen for its ability to provide very high gain in a single stage, and also for its single dominant pole compensation characteristics. The individual bias voltages are generated from a suitable bias voltage generator circuit. Since the operation amplifier has a dominant pole compensated by an output capacitance, a large hold capacitor (e.g., 1–10 microfarads) can be used to significantly reduce the bandwidth of operational amplifier 25 during the update phase $\phi 4$, and therefore lower the noise of band gap reference circuit 1A.

While the invention has been described with reference to several particular embodiments thereof, those skilled in the art will be able to make the various modifications to the described embodiments of the invention without departing from the true spirit and scope of the invention. It is intended that all elements or steps which are insubstantially different or perform substantially the same function in substantially the same way to achieve the same result as what is claimed are within the scope of the invention.

For example, the $\Delta V_{BE}$ voltages referred to herein can be the difference in $V_{BE}$ voltages produced by forcing first and second scaled or equal currents through different transistors, rather than the same transistor (e.g., Q1 or Q3) as disclosed above. The curvature compensation technique of the present invention is applicable to either kind of switched capacitor band gap reference circuit.

Furthermore, the $\Delta V_{BE3}$ curvature correction voltage developed across transistor Q3 of curvature correction circuit 3 does not necessarily need to be coupled to the same summing node 24 to which the $\Delta V_{BE1}$ band gap voltage developed across transistor Q1 is coupled. FIG. 9 shows an alternative embodiment in which the curvature correction voltage $A_{BE3}$ is produced across diode-connected transistor Q3 by causing $I_{PTAT/R}$ from current source 42 first to flow through transistor Q3 and then causing $I_{VBE/R}$ to also flow through transistor Q3 by turning on switch 14. This $\Delta V_{BE3}$ curvature correction voltage change charges up capacitor C4, while switch 26A is closed. In this embodiment, band gap reference voltage circuit 2B includes amplifier 25 connected in a non-inverting configuration relative to the $\Delta V_{BE}$ generating circuitry including current sources 44 and 45, switch 52, and diode-connected transistor Q1. The emitter of transistor Q1 is connected to the non-inverting input of amplifier 25. Feedback capacitor C2 is connected between output conductor 27A and summing node 24A, which is connected to the (−) input of amplifier 25. Capacitor C3 is connected between summing node 24A and ground, and, with feedback capacitor C2, determines the gain of the band gap reference circuit. The curvature correction charge is acquired in capacitor C4 by causing $I_{VBE/R}$ and then $I_{VBE/R}+I_{PTAT/R}$ to flow through transistor Q3. During the reference phase the curvature correction charge is transferred to feedback capacitor C2 and corrects the curvature of the band gap voltage being produced on conductor 27A in response to I and then I+NI flowing through transistor Q1.

The basic technique of acquiring charge on capacitor C4 and then transferring it to feedback capacitor C2 herein is the same as for other known switched capacitor band gap circuits. Therefore, the band gap circuit shown in FIG. 9 is considered to be a switched capacitor band gap reference circuit because switch 23 is operated to discharge capacitor C2 and because acquired charge is transferred from C4 to C2, even though the terminals of feedback capacitor C2 are not actually switched from one conductor to another.

It should be understood that the curvature correction voltage is not determined by either the magnitudes of the currents or the emitter area(s) of the transistor or transistors used to generate the two $V_{BE}$ voltages, the difference between which constitutes the $\Delta V_{BE}$ curvature correction voltage. What does cause the desired curvature correction voltage is that the two currents have different temperature coefficients. In the example of FIG. 2, one current is a PTAT/R current and the other is a 0TC/R current, whereas in the example of FIG. 3A one current is a $V_{BE}$/R current and the other is a PTAT/R current. Other pairs of currents with different temperature coefficients also could be used instead.

The curvature compensation circuit 3 described herein also could be used to compensate for temperature-dependent variation in a transfer characteristic of an amplifier circuit that is not used in a band gap generator circuit. For example, in FIG. 2, the circuitry including current sources 16 and 18, switches 17, 19, 21, 23, capacitor C2A, and transistor Q1 could be deleted to provide such a compensated circuit.

What is claimed is:

1. A method of compensating for temperature-dependent variation in an output voltage of an amplifier circuit, comprising:

(a) producing a $\Delta V_{BE}$ voltage in a compensation circuit by causing a first current and a second current to flow through a $\Delta V_{BE}$-generating circuit including at least a first transistor, and applying the $\Delta V_{BE}$ voltage to a first terminal of a capacitor having a second terminal coupled to a summing conductor coupled to an input of the amplifier, the first current having a different temperature coefficient than the second current; and (b) transferring an amount of charge representative of the $\Delta V_{BE}$ voltage through the summing conductor into the feedback capacitor to compensate for the curvature in the output voltage of the amplifier.

2. A method of compensating for curvature in a reference voltage produced by a band gap reference circuit, comprising:

(a) producing a $V_{BE}$ voltage and a first $\Delta V_{BE}$ voltage in a band gap reference circuit including an operational amplifier and a feedback capacitor coupled between an output of the operational amplifier and a summing conductor thereof, and producing the reference voltage in response to the $V_{BE}$ voltage and the first $\Delta V_{BE}$ voltage;

(b) producing a second $\Delta V_{BE}$ voltage in a curvature compensation circuit by causing a first current and a second current to flow through a $\Delta V_{BE}$-generating circuit including at least a first transistor, and applying the second $\Delta V_{BE}$ voltage to a first terminal of a capacitor having a second terminal coupled to the summing conductor, the first current having a different temperature coefficient than the second current; and (c) transferring an amount of charge representative of the second $\Delta V_{BE}$ voltage through the summing conductor into the feedback capacitor to compensate for the curvature in the reference voltage.

3. The method of claim 2 wherein one of the first and second circuits is a PTAT/R current.

4. A method of compensating for curvature in a reference voltage produced by a switched capacitor band gap reference circuit, comprising:

(a) producing a first $\Delta V_{BE}$ voltage in a switched capacitor band gap reference circuit and transferring a first amount of charge representative of the first $\Delta V_{BE}$ voltage through a summing conductor into a feedback capacitor of an operational amplifier producing the reference voltage;

(b) producing a second $\Delta V_{BE}$ voltage in a curvature compensation circuit by causing a first current and a second current to flow through a $\Delta V_{BE}$-generating circuit including at least a first transistor, and applying the second $\Delta V_{BE}$ voltage to a first terminal of a capacitor having a second terminal coupled to the summing conductor, the first current having a different temperature coefficient than the second current; and (c) transferring a second amount of charge representative of the second $\Delta V_{BE}$ voltage through the summing conductor into the feedback capacitor.

5. The method of claim 4 wherein one of the first and second currents is a PTAT/R current.

6. The method of claim 5 wherein the other of the first and second currents is a $V_{BE}$/R current.

7. The method of claim 5 wherein the other of the first and second currents is a 0TC/R current.

8. A method of compensating both for curvature in a reference voltage produced by a switched capacitor band gap reference circuit and an input offset voltage of an operational amplifier of the switched capacitor band gap reference circuit, comprising:

(a) producing a first $\Delta V_{BE}$ voltage in a switched capacitor band gap reference circuit by causing a first current and a second current to flow through a first $\Delta V_{BE}$ generating circuit, and applying the first $\Delta V_{BE}$ voltage to a first terminal of a first capacitor having a second terminal coupled to a summing conductor of the operational amplifier, the operational amplifier producing the reference voltage;

(b) producing a $V_{BE}$ voltage by causing a third current to flow through a transistor, and applying the $V_{BE}$ voltage to a first terminal of a feedback capacitor having a second terminal coupled to the summing conductor, the offset voltage of the operational amplifier being included in a voltage across the feedback capacitor;

(c) producing a second $\Delta V_{BE}$ voltage in a curvature compensation circuit by causing a fourth current and a fifth current to flow through a second $\Delta V_{BE}$ generating circuit, and applying the second $\Delta V_{BE}$ voltage to a first terminal of a second capacitor having a second terminal coupled to the summing conductor, wherein the temperature coefficient of the fourth current is different from the temperature coefficient of the fifth current;

(d) coupling the first terminal of the feedback capacitor to an output of the operational amplifier, the coupling functioning to compensate the offset voltage of the operational amplifier; and (e) transferring first and second charges representative of the first and second $\Delta V_{BE}$ voltages, respectively, from the first and second capacitors through the summing conductor into the feedback capacitor by operating the operational amplifier to maintain a virtual reference potential on the summing conductor by producing the reference voltage on the output.

9. The method of claim 8 wherein the third circuit is one of the first and second currents.

10. The method of claim 8 wherein the one of the fourth and fifth circuits is one of the first, second, and third currents.

11. A method of compensating for an input offset voltage of an operational amplifier of a switched capacitor band gap reference circuit, comprising:

(a) producing a $\Delta V_{BE}$ voltage by means of a switched capacitor band gap reference circuit by causing a first and a second current to flow through a $\Delta V_{BE}$ generating circuit, and applying the $\Delta V_{BE}$ voltage to a first terminal of a first capacitor having a second terminal coupled to a summing conductor of the operational amplifier, the operational amplifier producing the reference voltage;

(b) producing a $V_{BE}$ voltage by causing a current to flow through a transistor, and applying the $V_{BE}$ voltage to a first terminal of a feedback capacitor having a second terminal coupled to the summing conductor, the offset voltage of the operational amplifier being included in a voltage across the feedback capacitor;

(c) coupling the first terminal of the feedback capacitor to an output of the operational amplifier,the coupling functioning to compensate the offset voltage of the operational amplifier; and (d) transferring a charge representative of the $\Delta V_{BE}$ voltage from the first capacitor through the summing conductor into the feedback capacitor by operating the operational amplifier to maintain a virtual reference potential on the summing conductor by producing the reference voltage on the output.

12. A method of compensating for curvature in a reference voltage produced by a switched capacitor band gap reference circuit, comprising:

(a) producing a first $\Delta V_{BE}$ voltage in a switched capacitor band gap reference circuit by causing a first and then a second current to flow through a first $\Delta V_{BE}$-generating circuit including at least a first transistor, and applying the first $\Delta V_{BE}$ voltage to a first terminal of a first capacitor having a second terminal coupled to a summing conductor of an operational amplifier producing the reference voltage;

(b) producing a second $\Delta V_{BE}$ voltage in a curvature compensation circuit by causing a third current and then a fourth current to flow through a second $\Delta V_{BE}$-generating circuit including at least a second transistor, and applying the second $\Delta V_{BE}$ voltage to a first terminal of a second capacitor having a second terminal coupled to the summing conductor, the first and second currents having a first temperature coefficient, the third current having a temperature coefficient which is different than a temperature coefficient of the fourth current; and (c) transferring first and second charges representative of the first and second $\Delta V_{BE}$ voltages, respectively, from the first and second capacitors through the summing conductor into a feedback capacitor coupled between the summing conductor and an output of the operational amplifier by operating the operational amplifier to produce the reference voltage on the output by maintaining a virtual reference potential on the summing conductor.

13. The method of claim 12 including producing a $V_{BE}$ voltage by causing a fifth current to flow through a third transistor, storing a first charge corresponding to the $V_{BE}$ voltage in a third capacitor and also storing a second charge corresponding to the $V_{BE}$ voltage in the feedback capacitor, and then transferring the first charge corresponding to the $V_{BE}$ voltage through the summing conductor into the feedback capacitor.

14. The method of claim 13 including coupling the third capacitor in parallel with the feedback capacitor and then adjusting a voltage produced on the output to equal a predetermined band gap voltage.

15. The method of claim 13 including precisely scaling the reference voltage produced on the output in step (c) by trimming the capacitances of the third capacitor and the feedback capacitor so that the sum of the capacitances of the third capacitor and the feedback capacitor is constant.

16. The method of claim 15 including trimming the capacitance of the feedback capacitor by performing the steps of:

i. providing a capacitance trimming array including a first group of trim capacitors, a second group of trim capacitors, a first terminal, and a second terminal, the feedback capacitor being coupled between the first and second terminals; and ii. either 1) switching a trim capacitor of the first group into parallel connection with the feedback capacitor and simultaneously switching a corresponding trim capacitor of the second group out of parallel connection with the feedback capacitor in response to a first logic level of a corresponding bit of a digital trim word, or 2) switching a trim capacitor of the first group out of parallel connection with the feedback capacitor and simultaneously switching a corresponding trim capacitor of the second group into parallel connection with the feedback capacitor in response to the first logic level of the corresponding bit of a digital trim word to cause a change in the capacitance between the first and second terminals by an amount equal to the difference between the capacitances of the corresponding capacitors of the first and second groups.

17. The method of claim 15 including trimming the capacitances of the third capacitor and the feedback capacitor to maintain a constant sum of the capacitances of the feedback capacitor and the third capacitor by performing the steps of:

i. providing a capacitance trimming array including a first terminal, a second terminal, and a group of trim capacitors each having a plate coupled to the summing conductor, the feedback capacitor being coupled between the first terminal and the summing conductor, and the third capacitor being coupled between the summing conductor and the second terminal;

ii. either 1) switching a trim capacitor of the group into parallel connection with the feedback capacitor and simultaneously switching that trim capacitor of the group out of parallel connection with the third capacitor in response to a first logic level of a corresponding bit of a digital trim word, or 2) switching a trim capacitor of the group out of parallel connection with the feedback capacitor and simultaneously switching that trim capacitor of the group into parallel connection with the third capacitor in response to the first logic level of the corresponding bit of a digital trim word.

18. A method of compensating for curvature in a reference voltage produced by a switched capacitor band gap reference circuit, comprising:

(a) producing a first $\Delta V_{BE}$ voltage in a switched capacitor band gap reference circuit by causing a first and then a second current to flow through a first transistor, and applying the first $\Delta V_{BE}$ voltage to a first terminal of a first capacitor having a second terminal coupled to a summing conductor of an operational amplifier producing the reference voltage;

(b) producing a second $\Delta V_{BE}$ voltage in a curvature compensation circuit by causing a third current and then a fourth current to flow through a second transistor, and applying the second $\Delta V_{BE}$ voltage to a first terminal of a second capacitor having a second terminal coupled to the summing conductor, the first and second currents having a first temperature coefficient, the third current having a temperature coefficient which is different than a temperature coefficient of the fourth current; and (c) transferring first and second charges representative of the first and second $\Delta V_{BE}$ voltages, respectively, from the first and second capacitors through the summing conductor into a feedback capacitor coupled between the summing conductor and an output of the operational amplifier by operating the operational amplifier to produce the reference voltage on the output so as to maintain a virtual ground on the summing conductor.

19. The method of claim 18 including producing the second $\Delta V_{BE}$ voltage by causing the third current to flow through the second transistor during the first phase and causing both the fourth current and the third current to flow through the second transistor during the second phase.

20. The method of claim 18 including producing the first $\Delta V_{BE}$ voltage by causing the first current to flow through the first transistor during a first phase and causing both the first and second currents to flow through the first transistor during a second phase.

21. The method of claim 18 including producing a $V_{BE}$ voltage by causing a fifth current to flow through a third transistor, and applying the $V_{BE}$ voltage to a first terminal of a third capacitor having a second terminal coupled to the summing conductor.

22. A curvature compensated switched capacitor band gap reference circuit, comprising:

(a) a switched capacitor band gap reference circuit including a first transistor, a first current switching circuit adapted to produce first and second currents through the first transistor causing it to produce a first $\Delta V_{BE}$ voltage, a first capacitor coupled to receive the first $\Delta V_{BE}$ voltage and couple a corresponding first charge into a summing conductor and a feedback capacitor of an operational amplifier, and a second capacitor coupled to receive a $V_{BE}$ voltage and couple a corresponding second charge into the summing conductor and the feedback capacitor; and (b) a curvature correction circuit including a second transistor and a second current switching circuit adapted to produce a third current and a fourth current through the second transistor causing it to produce a second $\Delta V_{BE}$ voltage, a curvature correction capacitor coupled to receive the second $\Delta V_{BE}$ voltage and couple a corresponding curvature correction charge into the summing conductor and the feedback capacitor, to thereby produce a curvature compensated voltage on an output of the operational amplifier, the first and second currents having a first temperature coefficient, the third current having a temperature coefficient which is different than a temperature coefficient of the fourth current.

23. The curvature compensated switched capacitor band gap reference circuit of claim 22 wherein the first, second, and third currents are PTAT/R currents.

24. The curvature compensated switched capacitor band gap reference circuit of claim 23 wherein the fourth current is a $V_{BE}$/R current, and the second current switching circuit is adapted to cause the third current and then both the third current and the fourth current to flow through the second transistor.

25. The curvature compensated switched capacitor band gap reference circuit of claim 23 wherein the fourth current is a 0TC/R current, and the second current switching circuit is adapted to cause only the third current and then only the fourth current to flow through the second transistor.

26. The curvature compensated switched capacitor band gap reference circuit of claim 23 wherein the various PTAT/R currents are produced by applying a PTAT voltage across a resistor.

27. The curvature compensated switched capacitor band gap reference circuit of claim 22 including a first current source connected to produce a current through a third transistor causing it to produce the $V_{BE}$ voltage.

28. The curvature compensated switched capacitor band gap reference circuit of claim 27 wherein the current through the third transistor is a PTAT/R current.

29. The curvature compensated switched capacitor band gap reference circuit of claim 22 including a level shift current source coupled to a reference input of the operational amplifier and connected to produce a fourth current through a level shift transistor to produce a $V_{BE}$ level shifted $V_{BE}$ voltage on the reference input.

30. The curvature compensated switched capacitor band gap reference circuit of claim 27 wherein the $V_{BE}$ voltage produced by the third transistor is coupled to the feedback capacitor.

31. The curvature compensated switched capacitor band gap reference circuit of claim 27 wherein the first, second, and third transistors are PNP transistors each having a base and emitter coupled to a supply reference voltage, an emitter of the first transistor being coupled to a first terminal of the first capacitor, an emitter of the second transistor being coupled to a first terminal of the curvature correction capacitor, and an emitter of the third transistor being coupled to a first terminal of the second capacitor.

32. The curvature compensated switched capacitor band gap reference circuit of claim 31 including a fourth transistor, wherein the first current switching circuit includes a first switch adapted to switch the second current through the fourth transistor when the second current is not switched through the first transistor, and wherein the second current switching circuit includes a second switch adapted to switch the fourth current through the fourth transistor when the fourth current is not switched through the second transistor.

33. The curvature compensated switched capacitor band gap reference circuit of claim 31 wherein the curvature correction circuit includes a third switch adapted to switch the fourth current through the second transistor during a reference phase and the second current switching circuit is adapted to continuously produce the third current through the second transistor.

34. The curvature compensated switched capacitor band gap reference circuit of claim 33 wherein the first current switching circuit includes a fourth switch coupled to switch the second current through the first transistor during a charging phase and the first current switching circuit is adapted to continuously produce the first current through the first transistor.

35. The curvature compensated switched capacitor band gap reference circuit of claim 34 wherein the feedback capacitor includes a first terminal coupled to the summing conductor and a second terminal coupled by a fifth switch to the output of the operational amplifier during the reference phase and by a sixth switch to the emitter of the third transistor during the charging phase to charge the feedback capacitor to a voltage which includes an offset voltage of the operational amplifier as a component.

36. The curvature compensated switched capacitor band gap reference circuit of claim 35 wherein a second terminal of the second capacitor is coupled by a seventh switch to the emitter of the third transistor during the charging phase and by an eighth switch to the output of the operational amplifier during the reference phase to cancel the offset voltage and generate a band gap voltage.

37. The curvature compensated switched capacitor band gap reference circuit of claim 35 including a seventh switch adapted to couple the output of the operational amplifier to the summing conductor during the charging phase.

38. The curvature compensated switched capacitor band gap reference circuit of claim 36 including a ninth switch adapted to couple the second terminal of the second capacitor to the supply reference voltage during the reference phase.

39. A curvature compensated switched capacitor band gap reference circuit, comprising:

(a) a switched capacitor band gap reference circuit including a first $\Delta V_{BE}$-generating circuit including at least a first transistor, a first current switching circuit adapted to produce first and then second currents through the first $\Delta V_{BE}$-generating circuit causing it to produce a first $\Delta V_{BE}$ voltage and transfer a corresponding first charge into a summing conductor and a feedback capacitor of an operational amplifier, and a second capacitor coupled to store a $V_{BE}$ voltage and transfer a corresponding second charge into the summing conductor and the feedback capacitor; and (b) a curvature correction circuit including a second $\Delta V_{BE}$-generating circuit including at least a second transistor and a second current switching circuit adapted to produce a third current and then a fourth current through the second $\Delta V_{BE}$-generating circuit causing it to produce a second $\Delta V_{BE}$ voltage, a curvature correction capacitor coupled to receive the second $\Delta V_{BE}$ voltage and couple a corresponding curvature correction charge into the summing conductor and the feedback capacitor, to thereby produce a curvature compensated voltage on an output of the operational amplifier, the first, second and third currents being PTAT/R currents.

40. A capacitance trimming array including first, second, and third terminals, comprising:

(a) a first group of switches, a second group of switches, a first group of capacitors each having a first plate and a second plate, and a second group of capacitors each having a first plate and second plate;

(b) each of the switches of the first group having a first electrode coupled to the first terminal, a second electrode coupled to the first plate of a corresponding capacitor of the first group, and a control electrode coupled to receive a corresponding bit of a digital trim word, the second plate of each of the capacitors of the first group being coupled to the second terminal; and (c) each of the switches of the second group having a first electrode coupled to the first terminal, a second electrode coupled to the first plate of a corresponding capacitor of the second group, and a control electrode coupled to receive the logical complement of a corresponding bit of the digital trim word, the second plate of each capacitor of the second group being coupled to the second terminal.

41. A method of precisely trimming a capacitance of a main capacitor, comprising:

(a) providing a capacitance trimming array including a first group of trim capacitors, a second group of trim capacitors, a first terminal, and a second terminal, the main capacitor being coupled between the first and second terminals; and (b) either 1) switching a trim capacitor of the first group into parallel connection with the main capacitor and simultaneously switching a corresponding trim capacitor of the second group out of parallel connection with the main capacitor in response to a first logic level of a corresponding bit of a digital trim word, or 2) switching a trim capacitor of the first group out of parallel connection with the main capacitor and simultaneously switching a corresponding trim capacitor of the second group into parallel connection with the main capacitor in response to a logical complement of the first logic level of the corresponding bit of a digital trim word to cause a change in the capacitance between the first and second terminals by an amount equal to the difference between the capacitance of the corresponding trim capacitors of the first and second groups.

42. The method of claim 41 wherein the capacitance of the capacitor of the first group is slightly greater than the capacitance of the capacitor of the second group to cause the switching of step (b)(1) to provide a relatively small differential increase in the capacitance between the first and second terminals and to cause the switching of step (b)(2) to rovide a relatively small differential decrease in the capacitance between the first and second terminals.

43. A capacitance trimming array including first, second, and third terminals, comprising:

(a) a first group of switches, a second group of switches, a third group of switches, a fourth group of switches, a first group of capacitors each having a first plate and a second plate, and a second group of capacitors each having a first plate and second plate;

(b) each of the switches of the first group having a first electrode coupled to the first terminal, a second electrode coupled to the first plate of a corresponding capacitor of the first group, and a control electrode coupled to receive a corresponding bit of a digital trim word, the second plate of each of the capacitors of the first group being coupled to the third terminal;

(c) each of the switches of the second group having a first electrode coupled to the second terminal, a second electrode coupled to the first plate of a corresponding capacitor of the first group, and a control electrode coupled to receive a logical complement of a corresponding bit of the digital trim word;

(d) each of the switches of the third group having a first electrode coupled to the first terminal, a second electrode coupled to the first plate of a corresponding capacitor of the second group, and a control electrode coupled to receive the logical complement of a corresponding bit of the digital trim word, the second plate of each capacitor of the second group being coupled to the third terminal; and (e) each of the switches of the fourth group having a first electrode coupled to the second terminal, a second electrode coupled to the first plate of a corresponding capacitor of the second group, and a control electrode coupled to receive a corresponding bit of the digital trim word.

44. The capacitance trimming array of claim 43 wherein each switch of the first group includes a CMOS transmission gate, each switch of the third group includes a CMOS transmission gate, each switch of the second group includes an N-channel MOSFET, and each switch of the fourth group includes an N-channel MOSFET.

45. The capacitance trimming array of claim 43 wherein the difference between capacitances of corresponding capacitors of the first group and the second group are binarily weighted.

46. The capacitance trimming array of claim 45 wherein the capacitances of the capacitors of the second group are equal.

47. A method of producing an accurate reference voltage, comprising:

(a) providing an operational amplifier which produces the reference voltage on an output, a first capacitor having a first plate, and also a second plate coupled to a summing conductor of the operational amplifier, a second capacitor having a first plate, and also a second plate coupled to the summing conductor, and a feedback capacitor having a first plate, and also a second plate coupled to the summing conductor;

(b) trimming the capacitances of the second capacitor and the feedback capacitor to maintain a constant sum of the capacitances of the feedback capacitor and the second capacitor by performing the steps of:

i. providing a capacitance trimming array including a first terminal, a second terminal, and a group of trim capacitors each having a plate coupled to the summing conductor, the feedback capacitor being coupled between the first terminal and the summing conductor, and the second capacitor being coupled between the summing conductor and the second terminal, the first terminal being selectively switchable to a $V_{BE}$ voltage or to the output, the second terminal being selectively switchable to $V_{BE}$ voltage or the first terminal;

ii. either 1) switching a trim capacitor of the group into parallel connection with the feedback capacitor and simultaneously switching that trim capacitor of the group out of parallel connection with the second capacitor in response to a first logic level of a corresponding bit of a digital trim word, or 2) switching a trim capacitor of the group out of parallel connection with the feedback capacitor and simultaneously switching that trim capacitor of the group into parallel connection with the second capacitor in response to the first logic level of the corresponding bit of a digital trim word;

(c) producing a $\Delta V_{BE}$ voltage in a switched capacitor band gap reference circuit by causing a first current and a second current to flow through a $\Delta V_{BE}$ generating circuit, and applying the $\Delta V_{BE}$ voltage to a first plate of the first capacitor, the first capacitor having a second plate coupled to the summing conductor;

(d) producing a $V_{BE}$ voltage by causing a third current to flow through a transistor, and applying the $V_{BE}$ voltage to a first plate of the feedback capacitor, an offset of the operational amplifier being included in a voltage across the feedback capacitor;

(e) coupling the first plate of the feedback capacitor to the output of the operational amplifier, the coupling functioning to compensate the offset voltage of the operational amplifier; and (f) transferring a charge representative of the $\Delta V_{BE}$ voltage from the first capacitor through the summing conductor into the feedback capacitor by operating the operational amplifier to maintain a virtual reference potential on the summing conductor by producing the reference voltage on the output.

* * * * *